US006558510B1

(12) United States Patent
Edwards et al.

(10) Patent No.: US 6,558,510 B1
(45) Date of Patent: May 6, 2003

(54) WET-CREPE PROCESS UTILIZING NARROW CREPE SHELF FOR MAKING ABSORBENT SHEET

(75) Inventors: Steven L. Edwards, Fremont, WI (US); Robert J. Marinack, Oshkosh, WI (US)

(73) Assignee: Fort James Corporation, Deerfield, IL (US)

( * ) Notice: Subject to any disclaimer, the term of this patent is extended or adjusted under 35 U.S.C. 154(b) by 71 days.

(21) Appl. No.: 09/642,370

(22) Filed: Aug. 21, 2000

(51) Int. Cl.[7] ..... D21F 11/14; D21F 11/00

(52) U.S. Cl. ..... 162/111; 162/113; 162/117; 162/193

(58) Field of Search ..... 162/109, 111–113, 162/116, 117, 280–282, 123, 193; 264/282–283

(56) References Cited

U.S. PATENT DOCUMENTS

| | | | | | |
|---|---|---|---|---|---|
| 2,664,792 | A | | 1/1954 | Cook | |
| 2,995,180 | A | * | 8/1961 | Klenk | 264/283 |
| 3,017,317 | A | * | 1/1962 | Voigtman et al. | 162/111 |
| 3,432,936 | A | | 3/1969 | Cole et al. | |
| 4,184,429 | A | | 1/1980 | Widmer | 101/169 |
| 4,185,399 | A | | 1/1980 | Gladish | 34/120 |
| 4,208,459 | A | * | 6/1980 | Becker et al. | 428/154 |
| 4,356,059 | A | | 10/1982 | Hostetler | 162/111 |
| 4,432,927 | A | | 2/1984 | Tilburg | 264/282 |
| 4,665,859 | A | | 5/1987 | Dunlap et al. | 118/126 |
| 4,802,928 | A | | 2/1989 | Dunlap | 134/15 |
| 4,889,071 | A | | 12/1989 | Fundell | 118/126 |
| 4,895,071 | A | | 1/1990 | Benton | 101/169 |
| 4,919,756 | A | | 4/1990 | Sawdai | 162/111 |
| 4,984,326 | A | | 1/1991 | Horie et al. | 15/256.5 |
| 5,336,373 | A | * | 8/1994 | Scattolino et al. | 162/116 |
| 5,356,519 | A | | 10/1994 | Grabscheid et al. | 162/281 |
| 5,408,926 | A | | 4/1995 | Alder | 101/170 |
| 5,409,732 | A | | 4/1995 | Leonard et al. | 427/10 |
| 5,424,820 | A | | 6/1995 | Bares et al. | 355/298 |
| 5,520,731 | A | | 5/1996 | Esser et al. | 118/126 |
| 5,690,788 | A | * | 11/1997 | Marinack et al. | 162/113 |
| 5,851,353 | A | | 12/1998 | Fiscus et al. | 162/113 |
| 5,885,416 | A | * | 3/1999 | Marinack et al. | 162/111 |
| 5,885,417 | A | * | 3/1999 | Marinack et al. | 162/111 |
| 5,997,695 | A | | 12/1999 | Ilmarinen | 162/358.3 |
| 6,017,422 | A | | 1/2000 | Brox | 162/358.3 |
| 6,027,614 | A | | 2/2000 | Parker et al. | 162/281 |
| 6,066,234 | A | | 5/2000 | Parker et al. | 162/111 |
| 6,074,526 | A | * | 6/2000 | Marinack | 162/111 |
| 6,096,168 | A | * | 8/2000 | Marinack et al. | 162/111 |
| 6,187,139 | B1 | * | 2/2001 | Edwards et al. | 162/111 |

FOREIGN PATENT DOCUMENTS

| | | |
|---|---|---|
| IT | 615517 | 1/1961 |

* cited by examiner

*Primary Examiner*—Jose A. Fortuna
(74) *Attorney, Agent, or Firm*—Michael W. Ferrell

(57) ABSTRACT

There is provided a method of making absorbent sheet including the steps of: (a) an aqueous cellulosic furnish on a foraminous support; (b) at least partially dewatering the furnish to form a nascent web; (c) applying the nascent web to a rotating cylinder and drying the web to a consistency of from about 30 to about 90 percent solids; (d) creping the web at the consistency of from about 30 to about 90 percent while maintaining a narrow creping shelf effective width; and (e) drying the creped web to form an absorbent sheet, wherein the absorbent sheet exhibits a Void Volume of at least about 3.5 gms/gm. The process is advantageously applied to absorbent sheet having a thickness of from about 0.003 inches to about 0.010 inches while utilizing a creping blade having a creping surface with a ledge width of from about 0.005 inches to about 0.025 inches.

44 Claims, 13 Drawing Sheets

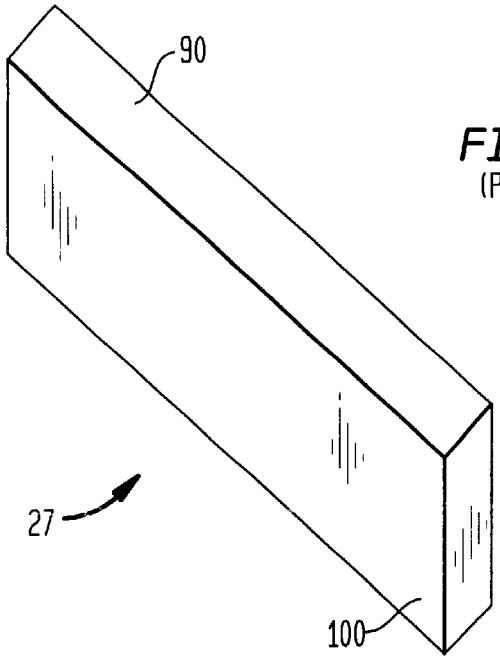
FIG. 9A
(PRIOR ART)
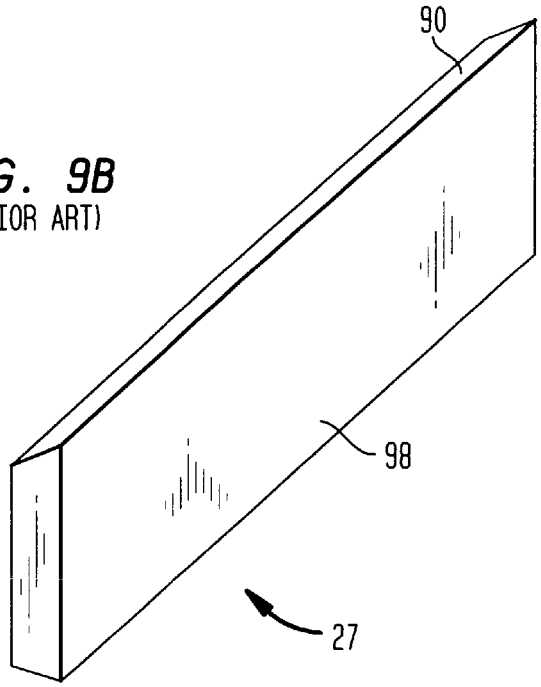
FIG. 9B
(PRIOR ART)
FIG. 9C
(PRIOR ART)
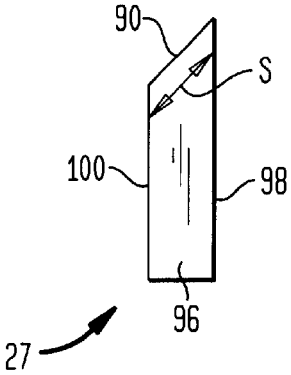

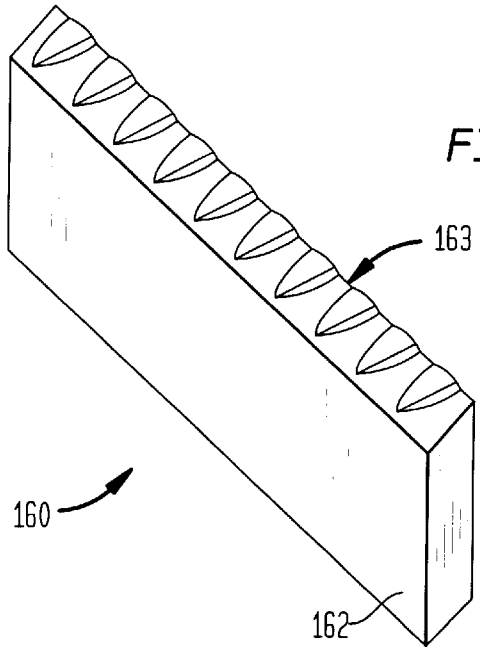
FIG. 14A
FIG. 14B
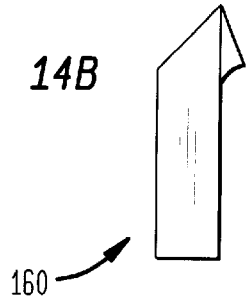
FIG. 14C
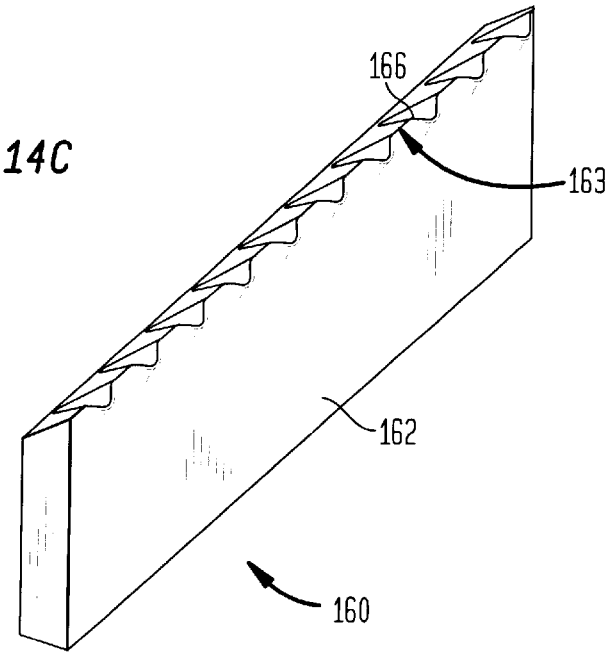

WET-CREPE PROCESS UTILIZING NARROW CREPE SHELF FOR MAKING ABSORBENT SHEET

TECHNICAL FIELD

The present invention relates generally to methods for making absorbent sheet and more particularly to a wet-crepe process utilizing a narrow crepe shelf configuration.

BACKGROUND

Wet crepe processes for making absorbent sheet are known in the art, for example, there is disclosed in U.S. Pat. No. 3,432,936 to Cole et al. a wet-crepe, throughair dry process wherein a web is creped off a Yankee cylinder and subsequently throughdried on an impression fabric. While various conditions may be employed, creping is carried out at 40 percent consistency (Example. 1) and drying rates approach 28 pounds of water removed/hour-ft$^2$ (Example 2).

U.S. Pat. No. 4,356,059 to Hostetler is directed to a system for producing absorbent sheet wherein the web is creped from a first creping surface, passes through a nip formed between a dewatering felt and a printing fabric and is applied to and creped from a second creping surface. According to the '059 patent, the web has a consistency of from about 40 to 50 percent after creping from the first rotating heated cylinder. See Column 3, lines 5–15.

U.S. Pat. No. 5,851,353 to Fiscus et al. discloses a method for can drying wet webs for tissue products to preserve wet bulk. In one embodiment, the patent describes restraining a wet-creped web between a pair of sheet molding fabrics. The restrained wet web is processed over a plurality of can dryers to dry the wet web, for example, from a consistency of from about 40 percent to a consistency of at least about 70 percent. The sheet molding in the fabrics protect the web from direct contact with the can dryers and impart an impression in the web. A can drying assembly and tissue machine for accomplishing the method are also disclosed. Prior to being restrained between the pair of molding fabrics, the wet web most typically has a consistency of from about 50 to about 60 percent. See Column 6, lines 1–5.

SUMMARY OF INVENTION

There is provided in accordance with the present invention a method of making absorbent sheet including the steps of: (a) depositing an aqueous cellulosic furnish on a foraminous support; (b) at least partially dewatering the furnish to form a nascent web; (c) applying the nascent web to a rotating cylinder and drying the web to a consistency of from about 30 to about 90 percent solids; (d) creping the web at the consistency of from about 30 to about 90 percent while maintaining a narrow creping shelf about a creping surface of a creping blade; and (e) drying the creped web to form the absorbent sheet, wherein the absorbent sheet exhibits a Void Volume of at least about 3.5 gms/gm. The process is advantageously applied to absorbent sheet having a thickness of from about 0.003 inches to about 0.010 inches. A preferred blade has creping ledge widths of from about 0.005 to about 0.025 inches.

In one embodiment, water may be pressed out of the sheet in a conventional cold press, either a roll or shoe press and the sheet is creped off one of the press rolls in accordance with the present invention. The sheet may then be molded into a fabric and dried in a single tier can section arrangement to produce a high porosity sheet.

As used herein the term percent or % refers to weight percent and the term consistency refers to weight percent of fiber unless the context indicates otherwise.

As used herein, "Void Volume" is determined by saturating a sheet with a nonpolar liquid and measuring the volume of liquid absorbed. The volume of liquid absorbed is equivalent to the Void Volume within the sheet structure. The Void Volume is expressed as grams of liquid absorbed per gram of fiber in the sheet structure. More specifically, for each single-ply sheet sample to be tested, 8 sheets are selected and cut out a 1 inch by 1 inch square (1 inch in the machine direction and 1 inch in the cross-machine direction). For multi-ply product samples, each ply is measured as a separate entity. Multiply samples should be separated into individual single plies and 8 sheets from each ply position used for testing. Weigh and record the dry weight of each test specimen to the nearest 0.0001 gram. Place the specimen in a dish containing POROFIL™ liquid, having a specific gravity of 1.875 grams per cubic centimeter, available from Coulter Electronics Ltd., Northwell Drive, Luton, Beds, England; Part No. 9902458.) After 10 seconds, grasp the specimen at the very edge (1–2 millimeters in) of one corner with tweezers and remove from the liquid. Hold the specimen with that comer uppermost and allow excess liquid to drip for 30 seconds. Lightly dab (less than ½ second contact) the lower comer of the specimen on #4 filter paper (Whatman Ltd., Maidstone, England) in order to remove any excess of the last partial drop. Immediately weight the specimen, within 10 seconds, recording the weight to the nearest 0.0001 gram. The Void Volume for each specimen, expressed as grams of POROFIL per gram of fiber, is calculated as follows:

$$\text{Void Volume}=[W_2-W_1)/W_1],$$

wherein

"$W_1$" is the dry weight of the specimen, in grams; and

"$W_2$" is the wet weight of the specimen, in grams.

The Void Volume for all eight individual specimens is determined as described above and the average of the eight specimens is the Void Volume for the sample.

BRIEF DESCRIPTION OF DRAWINGS

The invention is described in detail below with reference to the various figures wherein like numbers designate similar parts and wherein:

FIGS. 9A–C illustrate a creping blade with a conventional-style beveled profile useful for practicing the present invention;

FIGS. 14A through 14C illustrate a creping blade with a serrulated profile useful for practicing the process of the present invention;

DETAILED DESCRIPTION

Figure 1:
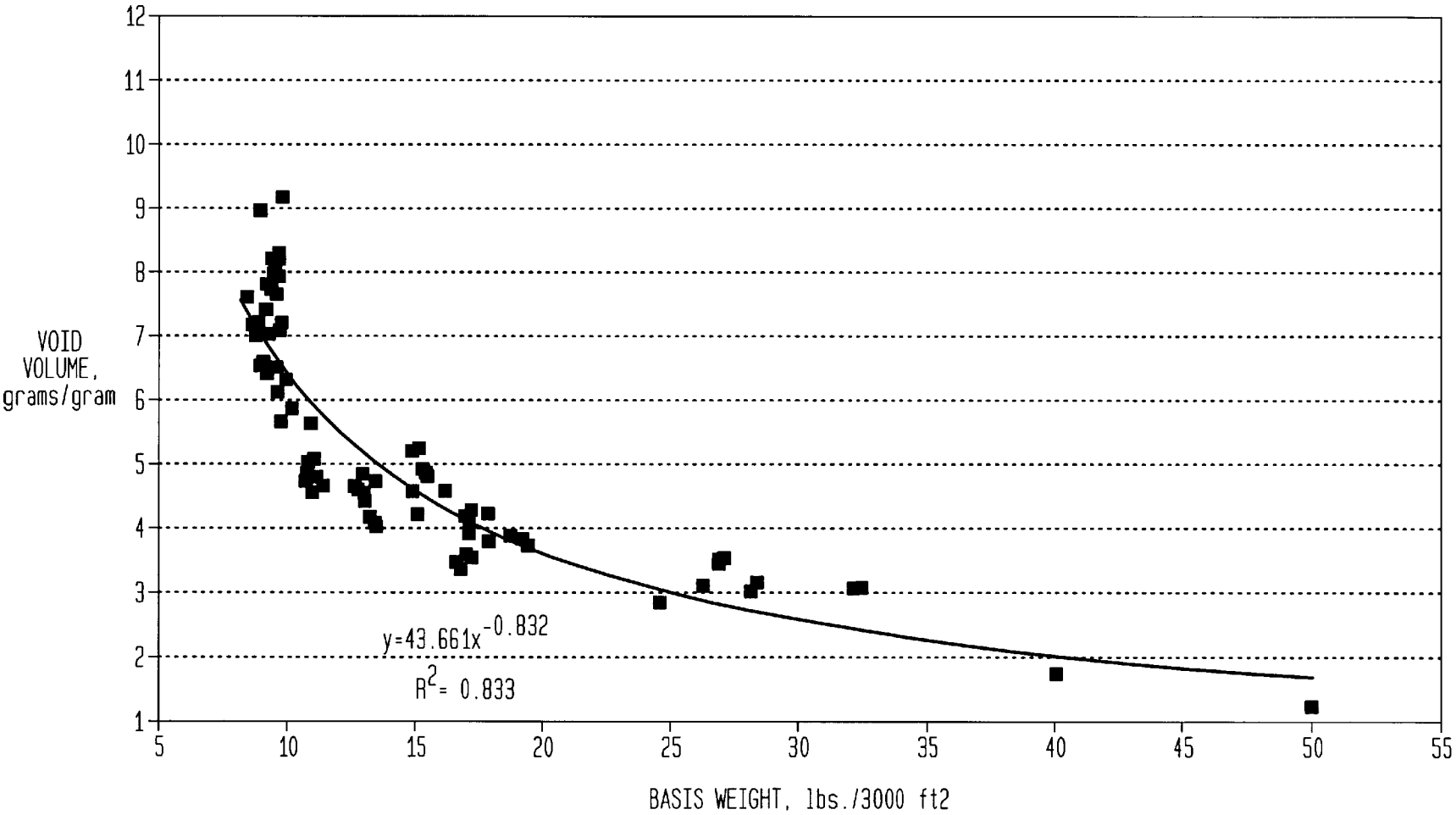
FIG. 1 is a plot of Void Volume vs. basis weight for typical base sheets prepared from recycle furnish wherein Void Volume is shown to be a function of basis weight.

The invention is described in detail below with reference to numerous embodiments thereof. Such discussion is for purposes of illustration only as modifications within the spirit and scope of the invention will be readily apparent to one of skill in the art. As noted above, the present invention is directed generally to a wet crepe process for making absorbent sheet wherein a web is creped at a consistency of from about 30 to about 90 percent while maintaining a narrow crepe effective shelf width. There is thus provided in one aspect of the present invention a method of making absorbent sheet including the steps of:

(a) depositing an aqueous cellulosic furnish on a foraminous support;

(b) at least partially dewatering the furnish to form a nascent web;

(c) applying the nascent web to a rotating cylinder (heated or unheated) and drying the web to a consistency of from about 30 to about 90 percent solids;

(d) creping the web while maintaining a narrow creping effective shelf width; and (e) drying the creped web to form the absorbent sheet, wherein the absorbent sheet exhibits a Void Volume of at least about 3.5.

The terms "effective shelf width" or "shelf effective width" and like terminology refers to the width of creped material contacting the creping surface, i.e., ledge of the creping blade. One way of maintaining a narrow creping shelf width is to utilize a creping blade with a narrow ledge. Another way to maintain a narrow effective shelf width is to adjust the takeoff angle of the creped web so that creped material does not accumulate on the creping surface of the creping blade. Still yet another method of maintaining a narrow creping shelf effective width is to utilize a blade geometry, such as a parabolic profile, which will not accumulate creped material thereon. These and other aspects of the invention will be further understood by the discussion which follows.

The present invention is particularly suitable for making relatively high bulk products, having a Void Volume of typically at least about 4, at least about 5, at least about 6, or at least about 7 gms/gm depending upon the particular product desired. In general, such products are produced by maintaining a creping-shelf effective width of less than about 3 times the thickness of the absorbent sheet; less than about 2 times the sheet thickness is preferred. In many embodiments one would maintain the creping shelf effective width at less than about 1.5 or 1.25 times the sheet thickness. In particularly preferred embodiments, the sheet has a caliper or thickness of about 0.003 to about 0.010 inches ("as dried" off of a Yankee dryer) and the creping blade employed has a creping ledge with a ledge width of from about 0.005 inches to about 0.025 inches.

Preferably, the creping ledge of the creping blade is formed from a low friction material such as polished metal, ceramic, or a polymeric material. Hydrophobic, polymeric materials such as fluoropolymers, eg., polytetrafluoroethylene (PTFE) are preferred in some embodiments. In other embodiments, a curvilinear surface such as a parabolic creping surface with a decreasing radius away from the creping zone may be used. In still other embodiments the narrow active creping shelf may be maintained by accelerated sheet removal wherein the direction of sheet take off makes an angle of less than about 60° with a tangent to the rotating cylinder at the creping line and still more preferably the sheet is removed along a direction making an angle of less than about 45° with a tangent to the rotating cylinder at the creping line.

In many embodiments recycled (secondary) fiber is employed in the papermaking furnish and in some embodiments the fiber component of the cellulosic furnish consists essentially of secondary fiber. In still other embodiments the fiber in the papermaking furnish is from about 5 to about 95 percent recycled fiber based on the weight of fiber in the furnish.

In general from about 10 to about 150 creped bars per inch are present in the product and when a serrulated creping blade is employed, there is generally from about 4 to about 50 ridges per inch along the machine direction of the product.

In many embodiments the process of the present invention involves compressively dewatering the papermaking furnish or nascent web and may include contacting the web with a papermaking felt or compressively dewatering the sheet in a shoe press or a nip press. After creping, the sheet may be macroscopically rearranged or molded on an impression fabric and through-dried if so desired.

For high speed applications, it is desirable in some embodiments to stabilize the wet transfer of the creped web over an open draw using an air foil.

The present invention is perhaps further appreciated by considering the differences between dry creping, and wet creping. In dry creping, maintaining several folds on the creping blade surface helps to keep the sheet against the Yankee dryer and therefore to improve the creping operation. In wet creping, the modulus properties of the sheet are vastly different from a dry sheet. The creping operation may adequately open a wet sheet but shortly thereafter the sheet may again be "recompressed" as it pushes the sheet folds off of the creping blade surface. While this may be a very small force, the sheet itself can be very easily compressed in this state. To verify this phenomena, a short trial was run with two different width creping blades. In one case the blade was a standard 0.050 inch thick steel blade, while in the other case a sharpened blade was modified to have a very narrow creping flat ledge, on the order of about 0.005 inches. In the first case up to about 10 times as much sheet could accumulate on the wide blade than on the narrow. The visual difference between these two sheets was dramatic. The sheet produced on the wide blade was totally unusable. It was not possible to pull out much of any of the "crepe" without breaking the sheet. The sheet produced on the narrow blade looked like a normal reeled sheet of tissue even though in both cases the sheet was removed without tension. The following Table 1 illustrates the Void Volume and basis weight data from these two samples.

TABLE 1

Effect of Creping Blade Width on Sheet Properties When Creped at About 70% Consistency

| Description | Wide Blade Sample | Narrow Blade Sample |
|---|---|---|
| Basis Weight (As collected) | 190 lbs./ream | 39.5 lbs./ream |
| Porofil ® Void Volume, gms/gm | 2.25 gms/gm | 4.0 gms/gm |

Further, the narrow blade sample could easily be pulled out in a uniform manner which should significantly improve capability to handle the wet sheet following the creping blade.

As can be seen from Table 1, the nearly doubled Void Volume indicates that if a sheet is properly handled, these wet pressed and wet creped sheets can perform much like throughair dried produced sheets. It was found that proper handling of the wet creped sheet is important so as not to reduce the Void Volume unnecessarily.

As will be appreciated from the discussion above, the present invention may be carried out in a variety of embodiments. One way to practice the present invention is to utilize narrow ledge creping blades whereas low friction ledges are likewise desirable. Coating the ledge surface with a water repellent material will reduce the drag of the wet sheet, especially when the consistencies drop below the free water threshold (around 60–65%), or one could make the blade out of a non-wetting plastic material such as a reinforced fluoropolymer. Another way to maintain a narrow crepe shelf width is to utilize a curvilinear blade so that material does not accumulate, or by accelerated sheet removal as discussed in more detail hereinafter.

The various advantages of the present invention, particularly achievable increases in product bulk without the use of relatively expensive debonder chemicals or fibers is better appreciated by reference to FIGS. 1–5.

FIG. 1 is a plot of Void Volume vs. basis weight for base sheet prepared from recycle fiber utilizing conventional creping techniques. As can be seen, Void Volume correlates well with basis weight for this data set ($R^2$=0.833) as an inverse power function ($y=43.661\ X^{-0.832}$) with basis weight).

Figure 2:
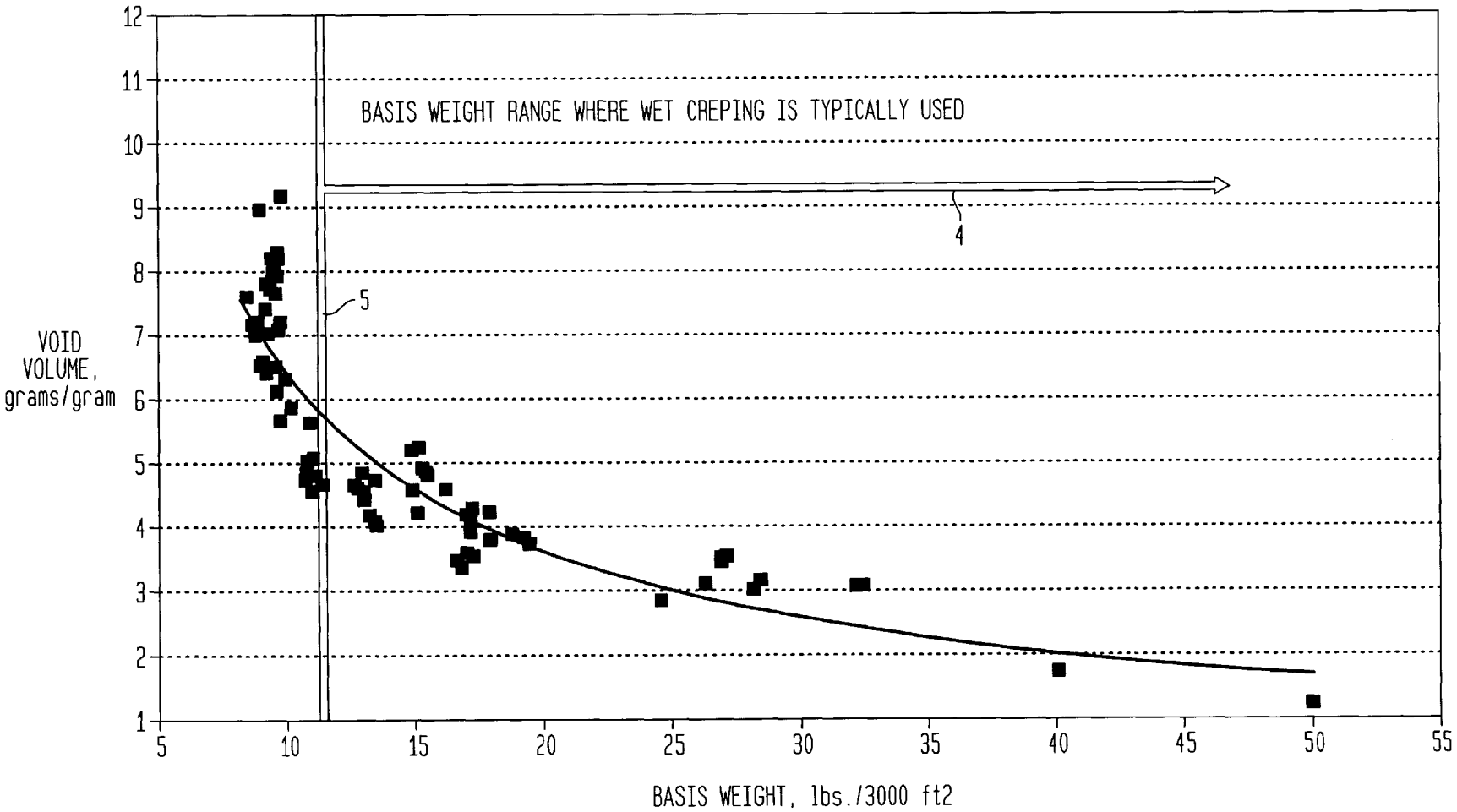
FIG. 2 is a plot similar to FIG. 1, wherein there is shown a range of basis weights (greater than about 11.5) wherein wet creping is typically employed.

FIG. 2 is a plot similar to FIG. 1 of the same data set, wherein there is illustrated a basis weight range 4 to the right of demarcation vertical 5 wherein wet creping is typically employed, that is, at a product basis weight range of greater than about 11.5. As can be seen from FIG. 2, the porofil Void Volumes in this basis weight range are conventionally from about a maximum of about 6 grams/gram at relatively low basis weights decaying to a lower value at high basis weights to a Void Volume value of less than about 2 grams/gram.

Figure 3:
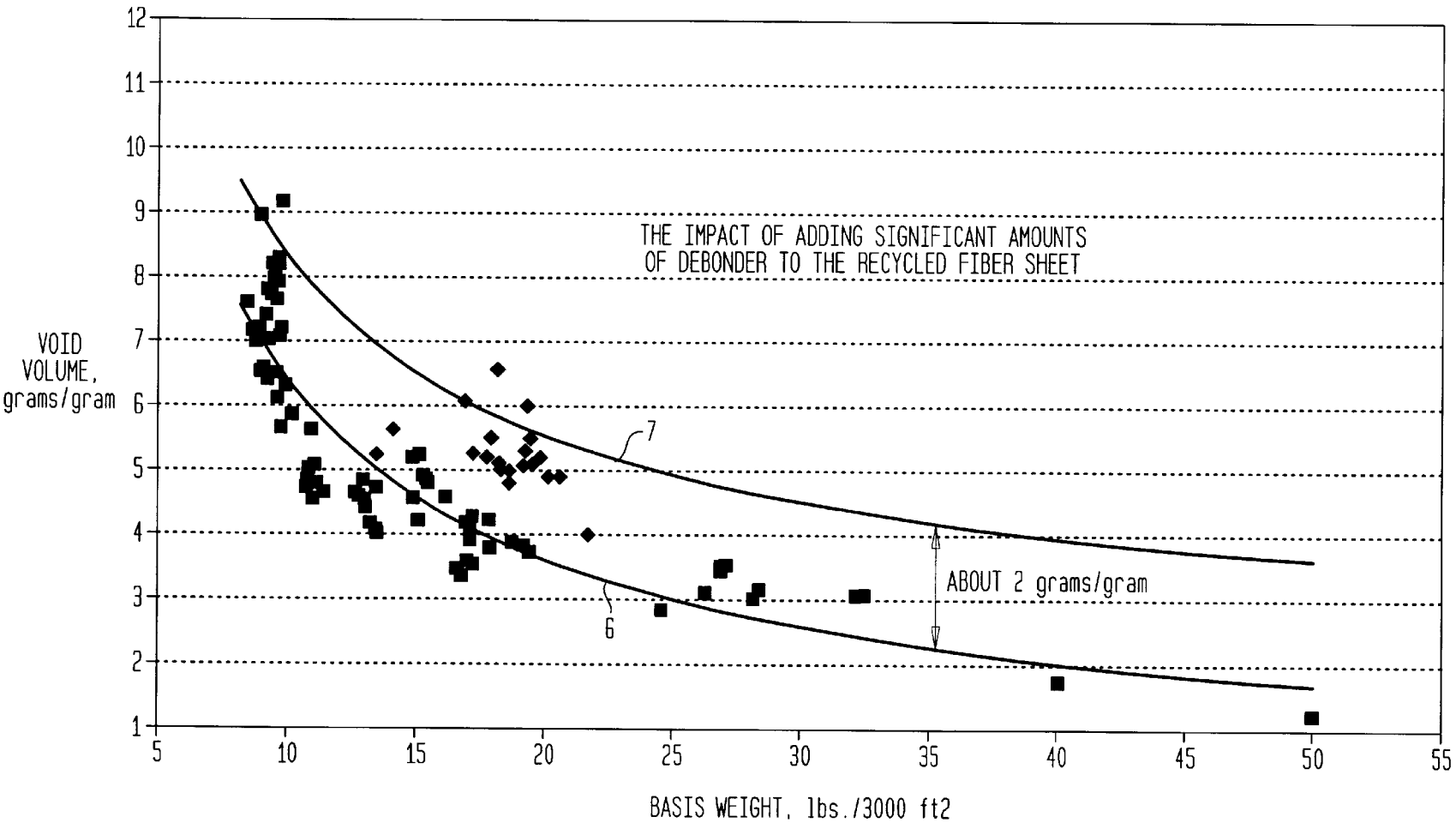
FIG. 3 is a plot similar to FIG. 1, illustrating the effect of adding significant amounts of debonder to the recycle base sheet.

FIG. 3 is a plot including the data set of FIG. 1 herein as the leftward or lower curve 6 wherein there is shown another data set which correlates along an upper or rightward curve 7. The upper data set represented by curve 7 is for base sheet prepared from recycle fiber wherein significant amount of debonder has been added. It was found that the Void Volume of conventional sheet prepared by processing techniques could be increased by adding debonder (a conventional means of preparing softer sheet) by about 2 grams/gram over a broad range of basis weights as can be seen from FIG. 3.

Figure 4:
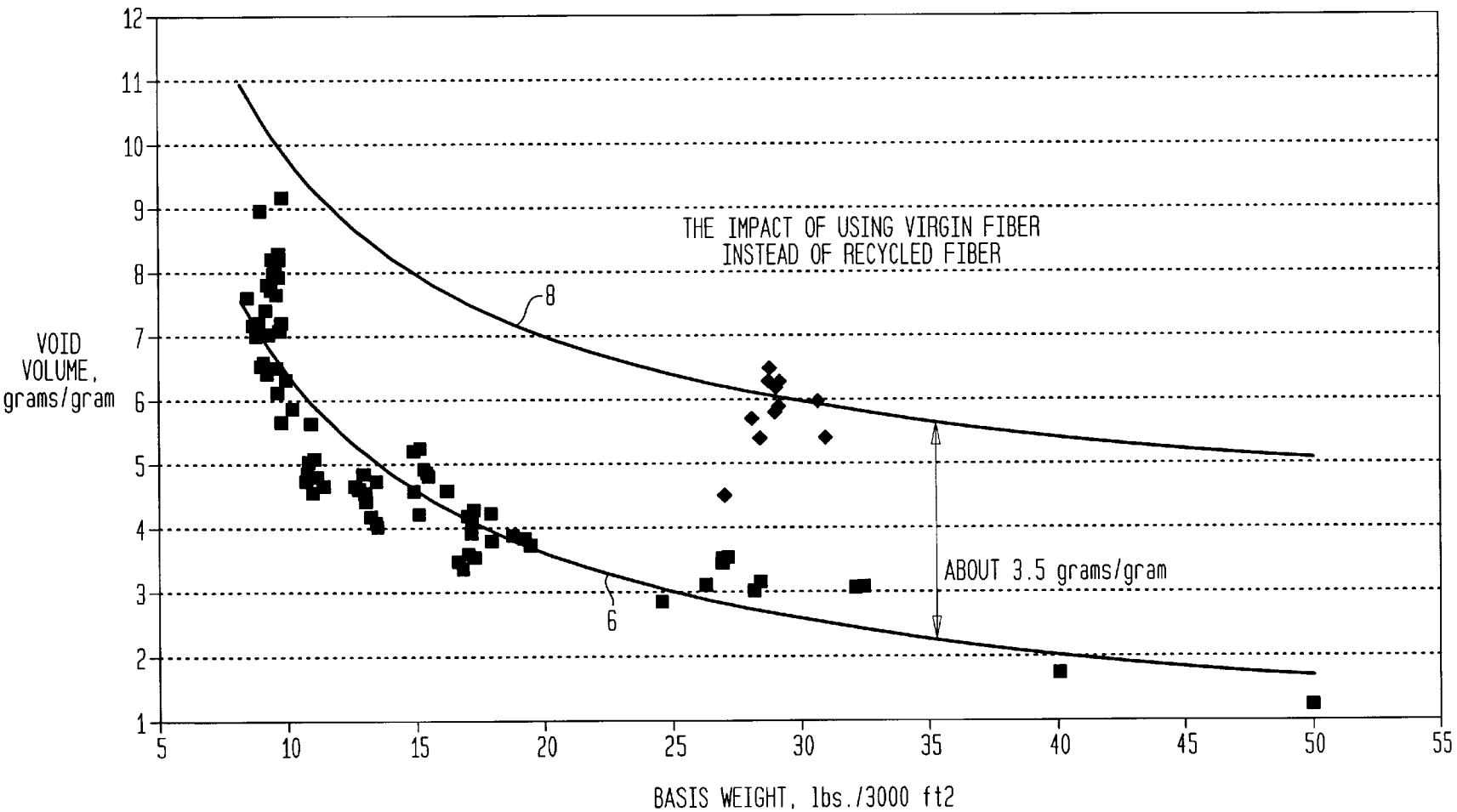
FIG. 4 is a plot similar to FIG. 1 showing the effect on Void Volume of using virgin fiber instead of recycle fiber.

Void Volume can also be increased over and above the characteristic Void Volumes of the data set of FIG. 1 by utilizing virgin fiber instead of recycle fiber as will be appreciated from FIG. 4. FIG. 4 is a plot showing curve 6 as described in connection with FIG. 3 as well as another data set correlating with curve 8. Curve 8 characterizes a data set for base sheets prepared from virgin fiber instead of recycle fiber, all other processing parameters being substantially similar to the recycle data set. By the use of virgin fiber as opposed to recycle fiber, it is possible to increase the Void Volume of the product by about 3.5 grams/gram over a broad range of basis weights. Here again, the use of virgin fiber as opposed to recycle fiber to increase softness and loft is known in the art.

Figure 5:
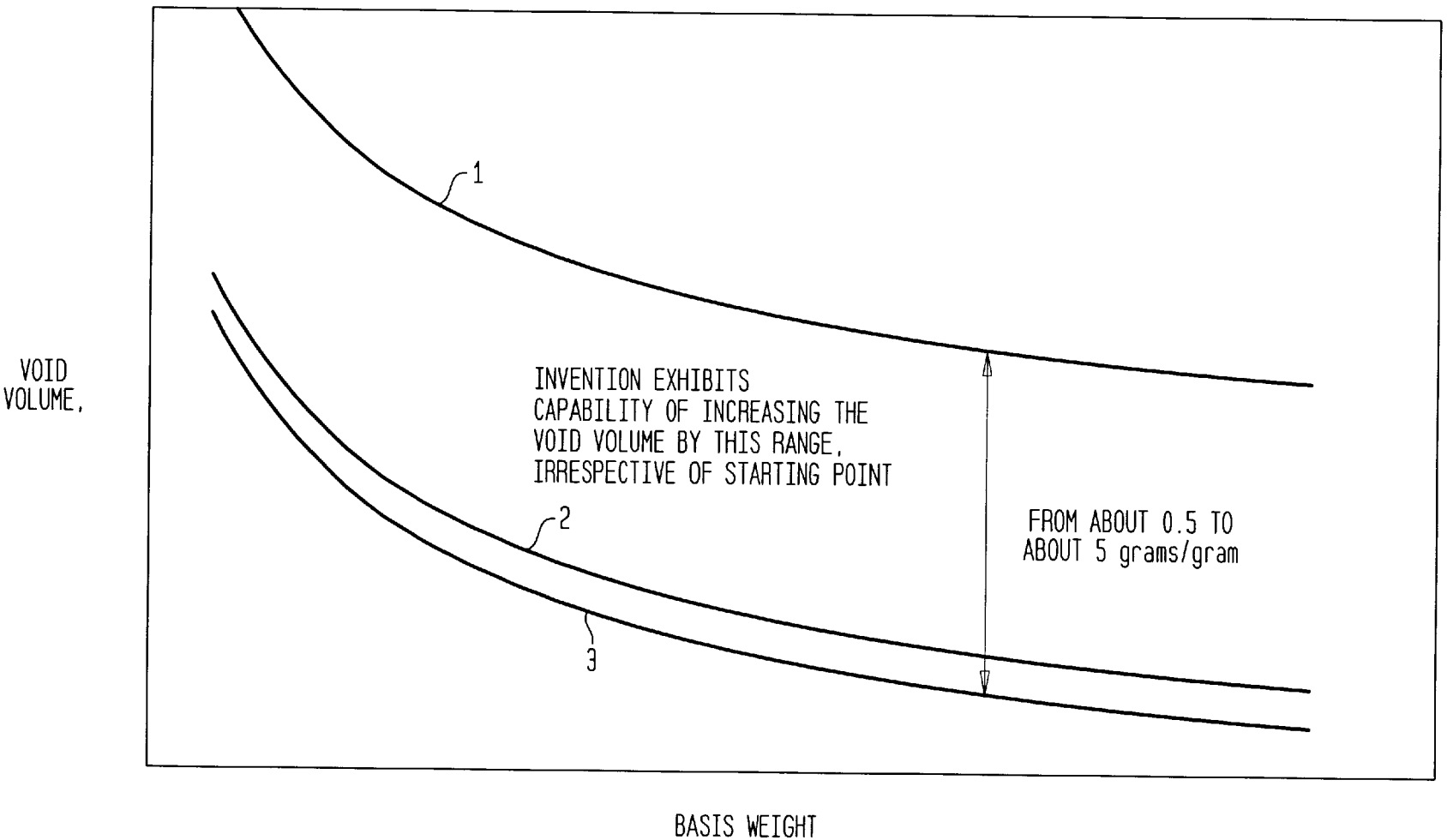
FIG. 5 schematically illustrates the impact of narrow shelf wet creping in accordance with the invention on Void Volume.

Void Volume increases of 3 to 4 grams/gram or more over a basis weight range of from about 11.5 lbs/3000 $ft^2$ ream to about 45 lbs/3000 $ft^2$ ream can be realized by way of the present invention as shown in FIG. 5. Curves 3, 2 represent data sets on base sheets prepared by conventional techniques, whereas curve 1 represents Void Volume, base sheet characteristics of product prepared by way of the inventive wet crepe/narrow crepe shelf process described herein. Rather than utilize additional debonder or virgin fiber, the Void Volume of a base sheet can be increased by way of the present invention, regardless of the starting material. In other words, the Void Volume of base sheets prepared from recycle furnish can be enhanced by way of the present invention and may be further independently enhanced by adding debonder if so desired. Likewise, the Void Volume of base sheet prepared from virgin fiber may be enhanced by 3 to 4 grams/gram or more over a broad range as noted above simply by utilizing the present invention without the use of relatively expensive chemicals. Increases of from about 0.5 to about 5 grams/gm are typical.

Further, since the invention works at quite low consistencies, in the range of 40–50%, there is the possibility of pressing the water out of the sheet in a conventional "cold" press, either roll or shoe, and creping this sheet off one of the press rolls using this invention, molding the sheet into a fabric and drying it in a single tier can section arrangement to produce a TAD like sheet. This application would be especially useful in converting an existing flat paper machine into a high quality, high basis weight tissue or towel machine at a minimum cost. Only the various felt and fabric runs would need to be modified. Particular embodiments of the present invention are further described below.

Papermaking fibers used to form the absorbent products of the present invention include cellulosic fibers commonly referred to as wood pulp fibers, liberated in the pulping process from softwood (gymnosperms or coniferous trees) and hardwoods (angiosperms or deciduous trees). Cellulosic fibers from diverse material origins may be used to form the web of the present invention. These fibers include non-woody fibers liberated from sugar cane, bagasse, sabai grass, rice straw, banana leaves, paper mulberry (i.e., bast fiber), abaca leaves, pineapple leaves, esparto grass leaves, and fibers from the genus hesperaloe in the family Agavaceae. Also, recycled fibers which may contain of the above fiber sources in different percentages, can be used in the present invention. Suitable fibers are disclosed in U.S. Pat. Nos., 5,320,710 and 3,620,911, both of which are incorporated herein by reference.

Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if necessary, by a number of familiar bleaching schemes including alkaline peroxide and ozone bleaching.

Fibers for use according to the present invention are also procured recycling of pre- and post-consumer paper products. Fiber may be obtained, for example, from the recycling of printers' trims and cuttings, including book and clay coated paper, post consumer paper including office and curbside paper recycling including old newspaper. The various collected paper can be recycled using means common to recycled paper industry. The papers may be sorted and graded prior to pulping in conventional low, mid, and high-consistency pulpers. In the pulpers the papers are mixed with water and agitated to break the fibers free from the sheet. Chemicals common to the industry may be added in this process to improve the dispersion of the fibers in the slurry and to improve the reduction of contaminants that may be present. Following pulping, the slurry is usually passed through various sizes and types of screens and cleaners to remove the larger solid contaminants while retaining the fibers. It is during this process that such waste contaminants as paper clips and plastic residuals are removed. The pulp is then generally washed to remove smaller sized contaminants consisting primarily of inks, dyes and fines. This process is generally referred to as deinking. Deinking, in the modem sense, refers to the process of making useful pulp from wastepaper while removing an ever increasing variety of objectionable, non-cellulosic materials.

The pulp can be mixed with strength adjusting agents such as wet strength agents, dry strength agents and debonders/softeners. Suitable wet strength agents are known to the skilled artisan. A comprehensive but non-exhaustive list of useful strength aids include urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the trade name of PAREZ 631NC by Cydec Industries. Different mole ratios of acrylamide/DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin resins, an example of which is sold under the trade names Kymene 557LXX and Kymene 557H by Hercules Incorporated of Wilmington, Del. and CASCAMID® from Borden Chemical Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2: *Alkaline-Curing Polymeric Amine-Eipichlorohydrin* by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable dry strength agents are likewise well-known in the art. A comprehensive but non-exhaustive list of useful dry strength aids includes starch, guar gum, polyacrylamides, carboxymethyl cellulose and the like. Of particular utility is carboxymethyl cellulose, an example of which is sold under the trade name Hercules CMC by Hercules Incorporated of Wilmington, Del.

In some embodiments, a particularly preferred debonder composition includes a quaternary amine component as well as a nonionic surfactant. The quaternary ammonium component may include a quaternary ammonium species selected from the group consisting of: an alkyl(enyl) amidoethyl-alkyl(enyl)-imidazolinium, dialkyldimethylammuonium, or bis-alkylamidoethyl-methylhydroxyethyl-ammonium salt; wherein the alkyl groups are saturated, unsaturated, or mixtures thereof, and the hydrocarbon chains have lengths of from ten to twenty-two carbon atoms. The debonding composition may include a synergistic combination of: (a) a quaternary ammonium surfactant component comprising a surfactant compound selected from the group consisting of a dialkyldimethyl-ammonium salts of the formula:

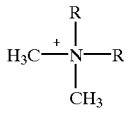

a bis-dialkylamidoammonium salt of the formula:

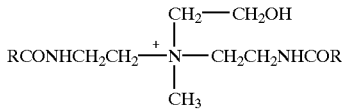

a dialkylmethylimidazolinium salt of the formula:

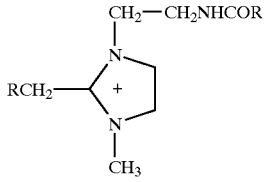

wherein each R may be the same or different and each R indicates a hydrocarbon chain having a chain length of from about twelve to about twenty-two carbon atoms and may be saturated or unsaturated; and wherein said compounds are associated with a suitable anion; and (b) a nonionic surfactant component. Preferably, the ammonium salt is a dialkylimidazolinium compound and the suitable anion is methylsulfate. The nonionic surfactant component typically includes the reaction product of a fatty acid or fatty alcohol with ethylene oxide such as a polyethylene glycol diester of a fatty acid (PEG diols or PEG diesters).

Some preferred softeners include Quasoft® 202-JR and 209-JR made by Quaker Chemical Corporation which include a mixture of linear amine amides and imidazoles of the following structure:

(i)

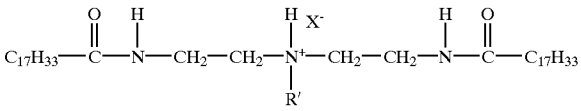

(ii)

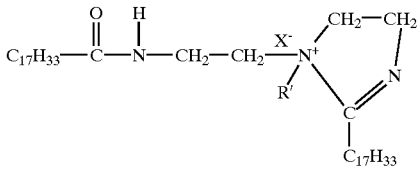

wherein X is an anion and R' is an organic radical.

As the nitrogenous cationic softener/debonder reacts with a paper product during formation, the softener/debonder ionically attaches to cellulose and reduces the number of sites available for hydrogen debonding, thereby decreasing the extent of fiber-to-fiber bonding.

Quasoft® 202-JR and 209-JR are derived by alkylating a condensation product of oleic acid and diethylenetriamine. Synthesis conditions using a deficiency of alkylating agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amines cyclize to imidazoline compounds. Since these materials are not quaternary ammonium compounds, they are pH-sensitive. Therefore, when using this class of chemicals, the pH in the headbox should be approximately 6 to 8, more preferably 6 to 7 and most preferably 6.5 to 7.

Other suitable softeners and debonders are described in the patent literature. A comprehensive, but non-exhaustive list includes U.S. Pat. Nos. 4,795,530; 5,225,047; 5,399,241; 3,844,880; 3,554,863; 3,554,862; 4,795,530; 4,720,383; 5,223,096; 5,262,007; 5,312,522; 5,354,425; 5,145,737; 5,725,736; and EPA 0 675 225. The entire disclosures of each of these patents are incorporated herein by reference.

These softeners are suitably nitrogen containing organic compounds, preferably cationic nitrogenous softeners, and may be selected from trivalent and tetravalent cationic organic nitrogen compounds incorporating long fatty acid chains; compounds including imidazoles, amino acid salts, linear amine amides, tetravalent or quaternary ammonium salts, or mixtures of the foregoing. Other suitable softeners include the amphoteric softeners, which may consist of mixtures of such compounds as lecithin, polyethylene glycol (PEG), castor oil, and lanolin.

The present invention may be used with a particular class of softener materials—amido amine salts derived from partially acid neutralized amines. Such materials are disclosed in U.S. Pat. No. 4,720,383; column 3, lines 40–41. Also relevant are the following articles: Evans, *Chemistry and Industry*, Jul. 5, 1969, pp. 893–903; Egan, *J. Am. Oil Chemist's Soc.*, Vol. 55 (1978), pp. 118–121; and Trivedi et al., *J. Am. Oil Chemist's Soc.*, June 1981, pp. 754, 756. All of the above are incorporated herein by reference. As indicated therein, softeners are often available commercially only as complex mixtures rather than as single compounds. While this discussion will focus on the predominant species, it should be understood that commercially available mixtures would generally be used to practice the invention.

The softener having a charge, usually cationic softeners, can be supplied to the furnish prior to web formation, applied directly onto the partially dewatered web, or applied by both methods in combination. Alternatively, the softener may be applied to the completely dried, creped sheet, either on the paper machine or during the converting process. Softeners having no change are applied at the dry end of the papernaking process.

The softener employed for treatment of the furnish is provided at a treatment level that is sufficient to impart a perceptible degree of softness to the paper product but less than an amount that would cause significant runnability and sheet strength problems in the final commercial product. The amount of softener employed, on a 100% active basis, is preferably from about 1 pound per ton of furnish up to about 25 pounds per ton of furnish. More preferred is from about 2 to about 15 pounds per ton of furnish.

Treatment of the web with the softener can be accomplished by various means. For instance, the treatment step can comprise spraying, applying with a direct contact applicator means, or by employing an applicator felt. When applying the softener after the web is formed, it can be sprayed with at least about 0.5 to about 3.5 lbs/ton of softener, more preferably about 0.5 to about 2.0 lbs/ton of softener. Alternatively, a softener may be incorporated into the wet end of the process to result in a softened web.

Imidazoline-based softeners that are added to the furnish prior to its formation into a web have been found to be particularly effective in producing soft tissue products and constitute a preferred embodiment of this invention. Of particular utility for producing the soft tissue product of this invention are the cold-water dispersible imidazolines. These imidazolines are mixed with alcohols or diols, which render the usually insoluble imidazolines water dispersible. Representative initially water insoluble imidazolines rendered water soluble by the water soluble alcohol or diol treatment include Witco Corporation's Arosurf PA 806 and DPSC 43/13, which are water dispersible versions of tallow and oleic-based imidazolines, respectively.

Treatment of the partially dewatered web with the softener can be accomplished by various means. For instance, the treatment step can comprise spraying, applying with a direct contact applicator means, or by employing an applicator felt. It is often preferred to supply the softener to the air side of the webs so as to avoid chemical contamination of the papermaking process. It has been found in practice that a softener applied to the web from either side penetrates the entire web and uniformly treats it.

Useful softeners for spray application include softeners having the following structure:

$$[(RCO)_2EDA]HX$$

wherein EDA is a diethylenetriamine residue, R is the residue of a fatty acid having from 12 to 22 carbon atoms and X is an anion or $$[(RCONHCH_2CH_2)_2NR']HX$$

wherein R is the residue of a fatty acid having from 12 to 22 carbon atoms, R' is a lower alkyl group, and X is an anion.

More specifically, preferred softeners for application to the partially dewatered web are Quasoft® 218, 202, and 209-JR made by Quaker Chemical Corporation, which contain a mixture of linear amine amides and imidazolines.

Another suitable softener is a dialkyl dimethyl fatty quaterary ammonium compound of the following structure:

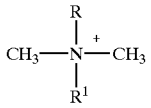

wherein R and R' are the same or different and are aliphatic hydrocarbons having fourteen to twenty carbon atoms, preferably the hydrocarbons are selected from the following $C_{16}H_{35}$ and $C_{18}H_{37}$.

A relatively new class of softeners are imidazolines, which have a melting point of about 0–40° C. in aliphatic diols, alkoxylated aliphatic diols, or a mixture of aliphatic diols and alkoxylated aliphatic diols. These are useful in the manufacture of the tissues of this invention. The imidazoline moiety in aliphatic polyols, aliphatic diols, alkoxylated aliphatic polyols, alkoxylated aliphatic diols or in a mixture of these compounds, functions as a softener and is dispersible in water at a temperature of about 1° C. to about 40° C. The imidazoline moiety is of the formula:

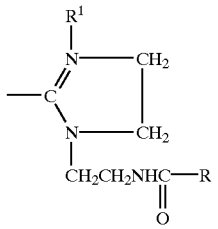

wherein X is an anion and R is selected form the group of saturated and unsaturated parafinic moities having a carbon chain of C12 to C20 and R1 is selected from the groups of methyl and ethyl moities. Suitably the anion is methyl sulfate of the chloride moiety. The preferred carbon chain length is $C_{12}$ to $C_{18}$. The preferred diol is 2,2,4 trimethyl 1,3 pentane diol, and the preferred alkoxylated diol is ethoxylated 2,2,4 trimethyl 1,3 pentane diol. A commercially available example of the type of softener is Arosurf® PA 806 manufactured by Witco Corporation of Ohio.

Preferred softeners and debonders also include Quasoft®206, Quasoft®216, Quasoft®228, Quasoft®230, and Quasoft®233, manufactured by the Quaker Chemical Company of Conshohocken, Pa., and Varisoft®475, Varisoft®3690, and Arosur® PA 806, which are available from Witco Corporation of Ohio.

In accordance with the present invention, an absorbent paper web can be made by dispersing fibers into aqueous slurry and depositing the aqueous slurry onto the forming wire of a papermaking machine. Any art recognized forming scheme might be used. For example, an extensive but non-exhaustive list includes a crescent former, a C-wrap twin wire former, an S-wrap twin wire former, a suction breast roll former, as well as Fourdrinier former. The particular forming apparatus is not critical to the success of the present invention. The forming fabric can be any art recognized foraminous member including single layer fabrics, double layer fabrics, triple layer fabrics, photopolymer fabrics, and the like. Non-exhaustive background art in the forming fabric area include U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808. The particular forming fabric is not critical to the success of the present invention. One forming fabric found particularly useful is Appleton Mills Forming Fabric 2184 made by Appleton Mills Forming Fabric Corporation, Florence, Miss. The fibrous web is, in some preferred embodiments, deposited on a de-watering felt and water is mechanically removed from the web. Any art recognized fabrics could be used with the present invention. For example, a non-exhaustive list of impression fabrics would include plain weave fabrics described in U.S. Pat. No. 3,301,746; semi-twill fabrics described in U.S. Pat. Nos. 3,974,025 and 3,905,863; bilaterally-staggered-wicker-basket cavity type fabrics described in U.S. Pat. Nos. 4,239,065 and 4,191,609; sculptured/load bearing layer type fabrics described in U.S. Pat. No. 5,429,686; photopolymer fabrics described in U.S. Pat. Nos. 4,529,480; 4,637,859; 4,514,345; 4,528,339; 5,364,504; 5,334,289; 5,275,799; and 5,260,171; and fabrics containing diagonal pockets described in U.S. Pat. No. 5,456,293. A wet-press-felt which may be particularly useful with the present invention is AMFlex 3 made by Appleton Mills Corporation. Others may be found in one or more of U.S. Pat. Nos. 5,657,797; 5,368,696; 4,973,512; 5,023,132; 5,225,269; 5,182,164; 5,372,876; and 5,618,612.

The web is suitably adhered to a Yankee dryer or other rotating cylinder by nip transfer pressing. The transfer may be accomplished by any art recognized method including, but not limited to, press rolls and belts. The machine configuration used to transfer the web to a Yankee can be any method that allows one to adhere the web to the dryer and create a profile that causes delamination upon creping. While this specification generally makes reference to a dryer from which the web is creped as a Yankee dryer, it should be understood that any dryer or rotating press roll from which the web is creped can be used. Example of alternative configurations would include the use of an impulse drying wide-shoe press against a heated back roll, or an extended nip press as further discussed herein.

To facilitate the creping process, adhesives are applied directly to the Yankee. Usual papermaking adhesives are suitable. Preferably nitrogen containing adhesives include glyoxylated polyacrylamides and polyaminoamides. Blends such as the glyoxylated polyacrylamnide blend comprise at least 40 weight percent of polyacrylamide and at least 4 weight percent of glyoxal. Polydiallyldimethyl ammonium chloride is not needed for use as an adhesive, but it is found in commercial products and is not detrimental to operations.

The preferred blends comprise about 2 to about 50 weight percent of the glyoxylated polyacrylamide, about 40 to about 95 percent of polyacrylamide.

Suitable polyaminoamide resins are disclosed in U.S. Pat. No. 3,761,354, the disclosure of which is incorporated herein by reference. The preparation of polyacryamide adhesives is disclosed in U.S. Pat. No. 4,217,425, the disclosure of which is incorporated herein by reference.

Other suitable adhesives are dislcosed in U.S. Pat. Nos. 5,730,839; 5,494,554; 5,468,796; 5,833,806; 5,944,954; 5,865,950; 4,064,213; 4,063,995; 4,304,625; 4,436,867; 4,440,898; 4,501,640; 4,528,316; 4,684,439; 4,788,243; 4,883,564; 4,886,579; 4,994,146; 5,025,046; 5,187,219; 5,246,544; 5,370,773; 5,326,434; 5,374,334; 5,382,323; 5,468,796; 54,490,903; 5,635,028; 5,660,687; 5,833,806; 5,786,429; 5,902,862; 5,837,768; 5,858,171, as well as Billmeyer, *Textbook of Polymer Science*, 3rd Ed., 1984, pp. 151–154, the entire disclosures of which are incorporated herein by reference.

Figure 6:
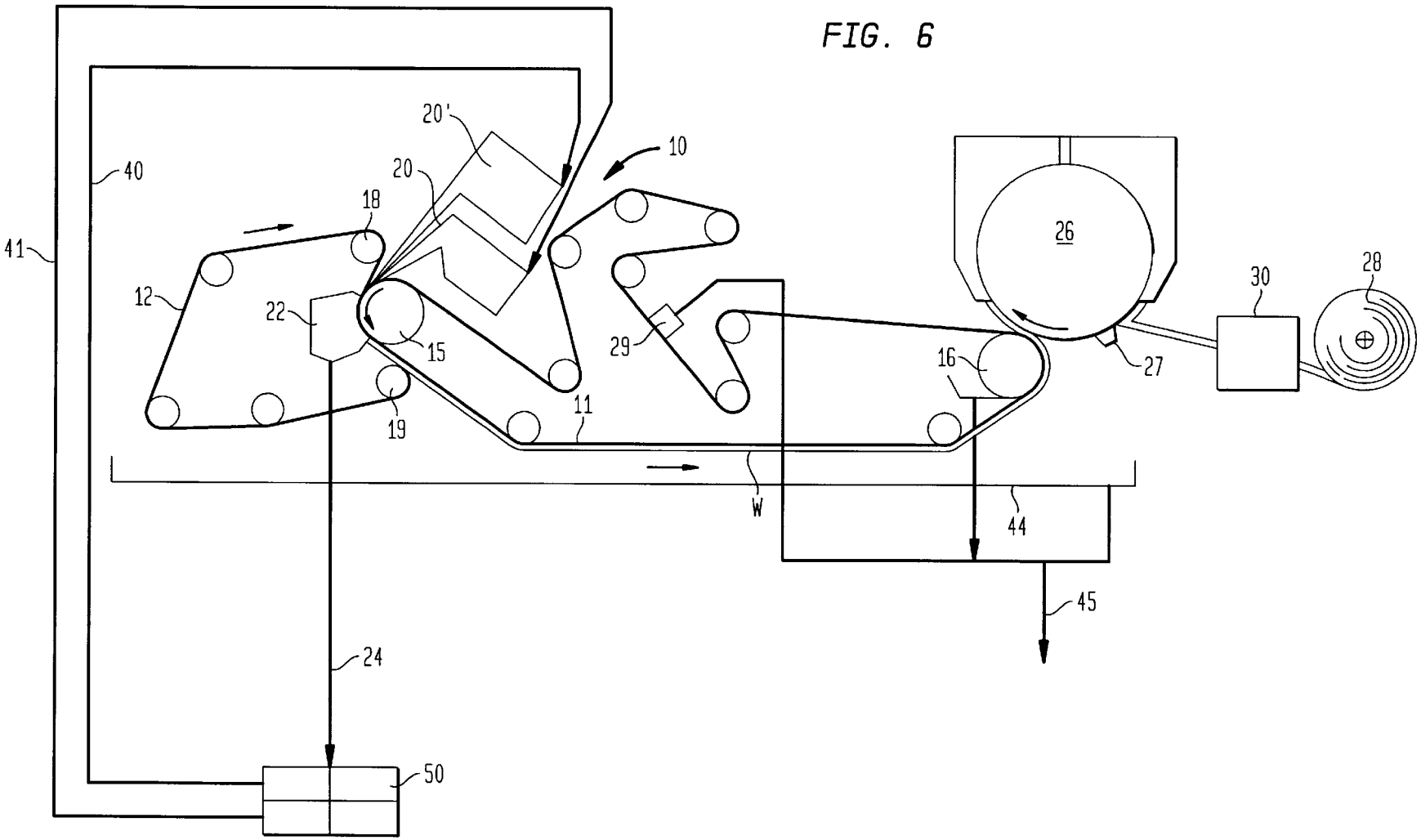
FIG. 6 is a schematic diagram illustrating a papermaking apparatus useful for practicing the process of the present invention.

FIG. 6 illustrates an embodiment of the present invention where a machine chest 50, which may be compartmentalized, is used for preparing furnishes that are treated with chemicals having different functionality depending on the character of the various fibers used. This embodiment shows two head boxes thereby making it possible to produce a stratified product. The product according to the present invention can be made with single or multiple head boxes and regardless of the number of head boxes may be stratified or unstratified. The treated furnish is transported through different conduits 40 and 41, where they are delivered to the head box or headboxes 20, 20' of a crescent forming machine 10.

FIG. 6 shows a web-forming end or wet end with a liquid permeable foraminous support member 11 which may be of any conventional configuration. Foraminous support member 11 may be constructed of any of several known materials including photopolymer fabric, felt, fabric, or a synthetic filament woven mesh base with a very fine synthetic fiber batt attached to the mesh base. The foraminous support member 11 is supported in a conventional manner on rolls, including breast roll 15 and couch or pressing roll, 16.

A forming fabric 12 is supported on rolls 18 and 19 which are positioned relative to the breast roll 15 for pressing the press wire 12 to converge on the foraminous support member 11. The foraminous support member 11 and the wire 12 move in the same direction and at the same time speed which is the same direction of rotation of the breast roll 15. The pressing wire 12 and the foraminous support member 11 converge at an upper surface of the forming roll 15 to form a wedge-shaped space or nip into which one or more jets of water or foamed liquid fiber dispersion provided by a headbox or headboxes 20, 20' is pressed between the pressing wire 12 and the foraminous support member 11 to force fluid through the wire 12 into a saveall 22 where it is collected to reuse in the process.

The nascent web W formed in the process is carried by the foraminous support member 11 to the pressing roll 16 where the next nascent web W is transferred to the drum 26 of a Yankee dryer. Fluid is pressed from the web W by pressing roll 16 as the web is transferred to the drum 26 of a dryer where it is partially dried and creped by means of a creping blade 27. The web then transferred to an additional drying section 30 to complete the drying of the web, prior to being collected on a take-up roll 28. The drying section 30 can have any art recognized configuration, including but not limited to, TAD, can dryers, impulse dryers, and the like as is further discussed in connection with FIG. 7.

A pit 44 is provided for collecting water squeezed from the furnish by the press roll 16 and a Uhle box 29. The water collected in pit 44 may be collected into a flow line 45 for separate processing to remove surfactant and fibers from the water and to permit recycling of the water back to the papermaking machine 10.

While the product according to the present invention is preferably made by wet pressing, any art recognized means for forming a nascent web that has a solids content of about 30 percent to 90 percent upon creping from a cylinder is suitable for use in the present invention. This may include transfer of the nascent web from the forming fabric to an impression fabric prior to application of the nascent web to the cylinder from which it will be creped. As stated, a preferred drying method is conventional wet pressing, i.e., on a pressing felt, followed by adherence to a Yankee dryer.

Creping is generally effected by removing the web that has been fixed to a Yankee dryer with an adhesive/release agent from the Yankee by means of a creping blade. Any currently art recognized, or after developed style of creping blade may be used in the process according to the present invention. The creping blade may be of conventional rectangular or beveled profile, or may be a patented undulatory creping blade, disclosed in U.S. Pat. No. 5,690,788, which is incorporated herein by reference in its entirety. This undulatory blade presents differentiated creping and rake angles to the sheet and having a multiplicity of spaced serrulated creping section so of either uniform depths or non-uniform arrays of depths. The depths of the undulations are typically above about 0.008 inches and are further discussed herein. In still further embodiments of the present invention, creping blades with a stepped profile may be employed, of the general type disclosed in U.S. Pat. No. 6,027,614, the disclosure of which is also incorporated by reference.

Creping, by breaking a significant number of inter-fiber bonds, adds to and increases the perceived softness of resulting tissue or towel product. The creping angle is preferably between about 60 and about 95 degrees, more preferably between about 65 and about 90 degrees, and most preferably between about 70 and about 85 degrees.

The present invention is practiced, in one embodiment, in connection with high speed transfer over an open draw and wet shaping the air side of the web after it is creped from the Yankee dryer and before it is throughdried is also discussed below in connection with FIG. 7. The throughdry fabric is suitably a coarse fabric such that the wet web is supported in some areas and unsupported in others in order to enable the web to flex in response to differential air pressure or other deflection force applied to the web. Such fabric suitable for purposes of this invention include, without limitation, those papermaking fabrics which exhibit significant open area or three dimensional surface contour or depression sufficient to impart substantial Z-directional deflection of the web and are disclosed, for example, in U.S. Pat. No. 5,411,636 to Hermans et al.

Suitable impression or throughdrying fabrics include single layer, multi-layer, or composite permeable structures. Preferred fabrics have at least one of the following characteristics: (1) on the side of the molding fabric that is in contact with the wet web (the "top" side), the number of machine direction (MD) strands per inch (mesh) is from 10 to 200 and the number of cross direction (CD) strands per inch (count) is also from 10 to 200. The strand diameter is typically smaller than 0.050 inch; (2) on the top side, the distance between the highest point of the MD knuckle and the highest point on the CD knuckle is from about 0.001 to about 0.02 or 0.03 inch. In between these two levels there can be knuckles formed either by MD or CD strands that give the topography a three dimensional hill/valley appearance which is imparted to the sheet during the wet molding step; (3) on the top side, the length of the MD knuckles is equal to or longer than the length of the CD knuckles; (4) if the fabric is made in a multi-layer construction, it is preferred that the bottom layer is of a finer mesh than the top layer so as to control the depth of web penetration to maximize fiber retention; and (5) the fabric may be made, to show certain geometric patterns that are pleasing to the eye, which is typically repeated between every two to 50 warp yarns. Suitable commercially available coarse fabrics include a number of fabrics made by Asten Forming Fabrics, Inc., including without limitation Asten 934, 920, 52B, and Velostar V-800.

The consistency of the web when the differential pressure is applied must be high enough that the web has some integrity and that a significant number of bonds have formed within the web, yet not so high as to make the web unresponsive to the differential air pressure or other pressure applied to force the web into the impression fabric. At consistency approaching dryness, for example, it is difficult to draw sufficient vacuum on the web because of its porosity and lack of moisture. Preferably the consistency of the web about its surface will be from about 30 to about 80 percent and more preferably from about 40 to about 70 percent and still more preferably from about 45 to about 60 percent. While the invention as illustrated below in connection with vacuum molding, the means for deflecting the wet web to create the increase in internal bulk can be pneumatic means, such as positive and/or negative air pressure or mechanical means such as a male engraved roll having protrusions which match up with the depressions in the coarse fabric. Deflection of the web is preferably achieved by differential air pressure, which can be applied by drawing vacuum through the supporting coarse fabric to pull the web into the coarse fabric or by applying the positive pressure into the fabric to push the web into the coarse fabric. A vacuum suction box is a preferred vacuum source because it is common to use in papermaking processes. However, air knives or air presses can also be used to supply positive pressure where vacuums cannot provide enough pressure differential to create the desired effect. When using a vacuum suction box the width of the vacuum slot can be from approximately 1/16 inch to whatever size is desired as long as sufficient pump capacity exists to establish sufficient vacuum time. It is common practice to use vacuum slot from 1/8 inch to 1/2 inch.

The magnitude of the pressure differential and the duration of the exposure of the web to the pressure differential can be optimized depending on the composition of the furnish, the basis weight of the web, the moisture content of the web, the design of the supporting coarse fabric and the speed of the machine. Suitable vacuum levels can be from about 10 inches of mercury to about 30 inches of mercury, preferably from about 15 to about 25 inches of mercury and most preferably about 20 inches of mercury.

Figure 7:
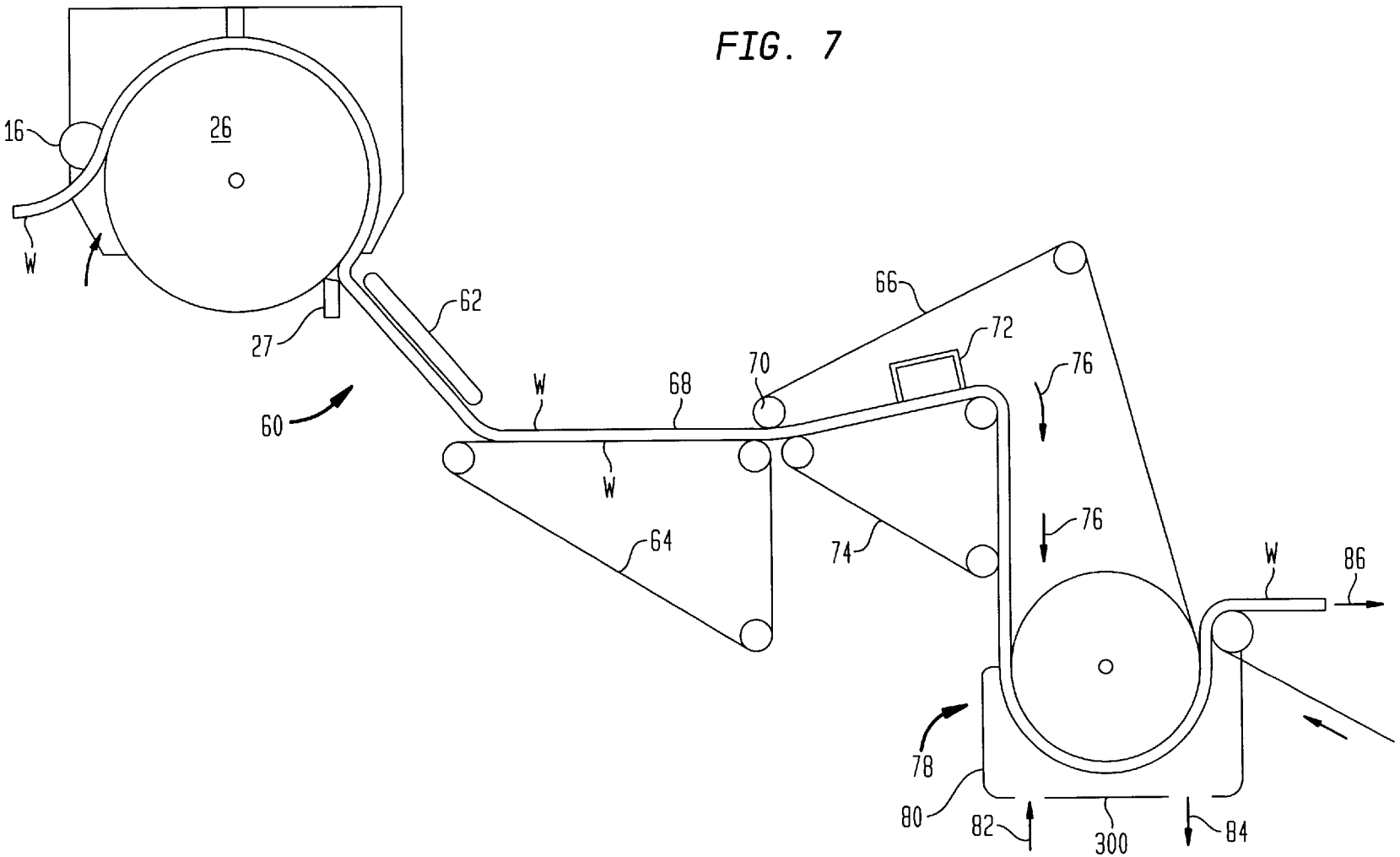
FIG. 7 is a schematic diagram illustrating a drying section of a papermaking apparatus such as that of FIG. 1 useful for practicing the process of the present invention.

FIG. 7 shows a web W being applied to a Yankee dryer 26 as discussed above wherein the web W is partially dried on the Yankee and creped by creping blade 27 at a consistency of from about 30 to about 90 percent. The web W is then transferred over an open draw indicated at 60 while being supported by an air foil 62. Air foil 62 may be a passive air foil which may be contoured or uncontoured or the air foil may be a Coanda effect air foil as is shown for example in U.S. Pat. No. 5,891,309 to Page et al. the disclosure of which is hereby incorporated by reference. After transfer over open draw 60 the web W is placed upon a transfer fabric 64 which conveys the web to a throughdry fabric 66 having the characteristics noted above. It is noted at this point that the air side of the web indicated at 68 is disposed upwardly with respect to transfer fabric 64. Web W is then transferred to fabric 66 optionally by utilizing a suction roll 70. Web W when transferred to molding or throughdrying fabric 66 it is downwardly disposed with respect to that fabric and is vacuum molded by way of a vacuum box 72 as indicated on FIG. 7. Here it is noted that the air side 68 of Web W is pulled upwardly into the fabric 66 by way of vacuum box 72. There is optionally provided another transfer fabric 74 which serves to support the web over the drying loop. After molding, web W continues as shown by arrows 76 to a throughdrying unit indicated at 78. Throughdrying unit 78 includes a hood 80 provided with means for supplying heated air at 82 and exhaust means for removing air at 84. It is noted that throughdryers are well known in the art as is shown, for example, in U.S. Pat. No. 3,432,936 to Cole et al.

Web W is finally dried in unit 78 to greater than 95 percent consistency and the web is transferred to a take up reel, for example, as indicated at 86.

Figure 8:
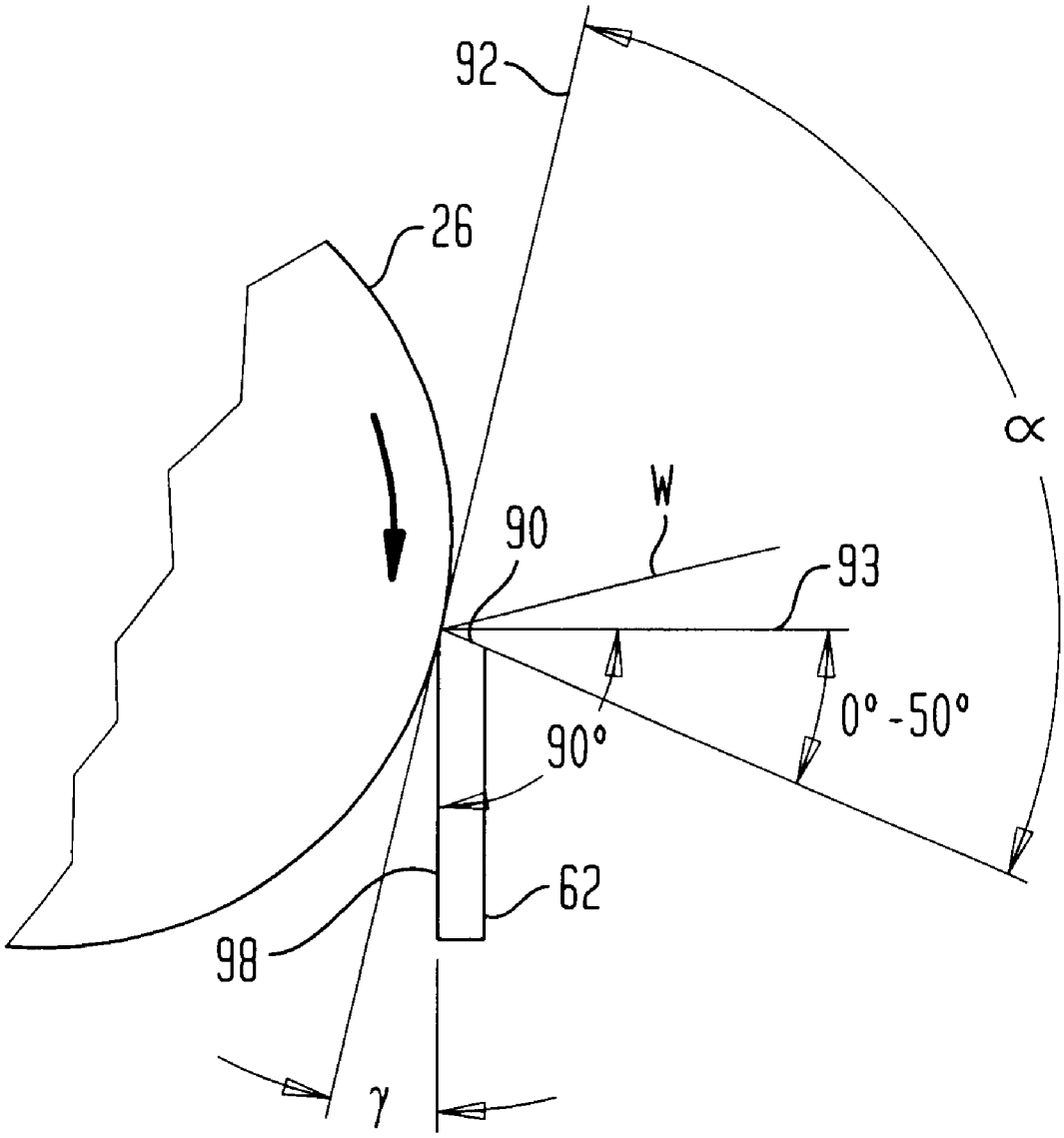
FIG. 8 is a schematic diagram illustrating various angles.

The creping angle, $\alpha$, is the angle that the creping shelf surface 90 makes with a tangent 92 to a Yankee dryer at the line of contact of the creping blade with the rotating cylinder as will be appreciated from FIG. 8. So also, an angle $\gamma$ is defined as the angle the blade body makes with tangent 92, whereas the bevel angle of creping blade 27 is the angle surface 90 defines with a perpendicular 93 to the blade body as shown in the diagram. As noted earlier, the creping angle $\alpha$ is suitably from about 60 to about 95 degrees, whereas bevel angles may be anywhere from about 0 to bout 50 degrees with from about 5 to about 15 degrees being typical.

FIGS. 9A–9C illustrate a portion of a conventionally-styled beveled creping blade 27 which may be utilized in accordance with the present invention (likewise a rectangular profile may be employed). Blade 27 includes a creping shelf surface 90 defining a creping ledge width of length, S, a blade body 96 which has an inner body surface 98 and an outer body surface 100. In operation, blade 27 is juxtaposed, for example, with Yankee dryer 26 as shown in FIG. 6 such that shelf surface 90 contacts the wet web W during creping. One method, and perhaps a preferred method of ensuring that the creping shelf effective width is no more than about 3 times the sheet thickness is to make the length s sufficiently small so that it is not possible to accumulate more material than can be supported on surface 90. Most preferably, the distance over which material accumulates on the surface of the creping blade should be only slightly greater than the sheet thickness on the Yankee dryer prior to creping. Practical means of executing this include lightly loaded narrow shelf steel creping blades and ceramic blades ground in a fashion so as to self sharpen while maintaining the desired ledge width. Other methods of controlling the distance over which creped material accumulates on a creping blade shelf surface such as surface 90 include carefully selected blade surface material, geometry and accelerated sheet removal as further discussed herein.

In all cases, the creping shelf effective width, that is, the distance in the direction of travel of the web wherein web material accumulates on a creping blade ledge is less than about 3 times (and most preferably only slightly greater than) the thickness of the wet web on the Yankee dryer prior to creping thereof. For purposes of convenience, however, the crepe shelf width effective is also defined in terms of thicknesses of dry sheet in various portions hereof.

Figure 10:
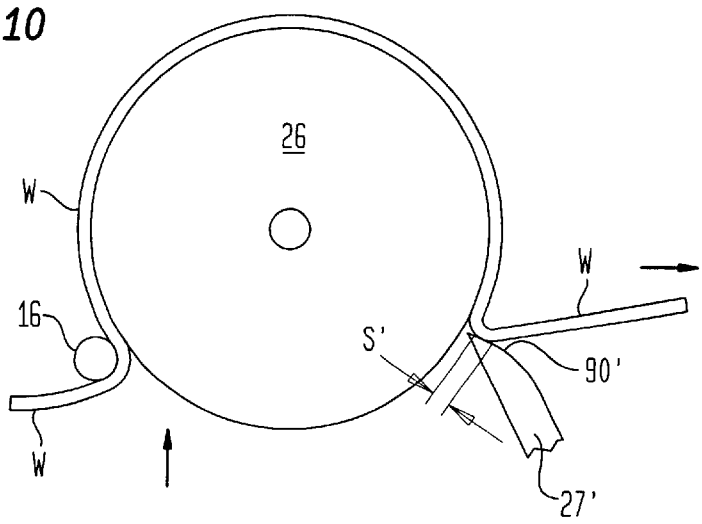
FIG. 10 is a schematic diagram illustrating the use of a creping blade with a parabolic profile useful for practicing the process of the present invention.

The invention is further appreciated by reference to FIG. 10. Web W is applied to a Yankee dryer 26 by way of a press roll 16 as discussed in connection with FIG. 1. Web W is thereafter dried to a consistency of from about 30 to about 90 percent prior to being creped by blade 27'. Blade 27' is provided with a parabolic creping ledge 90' with a decreasing radius away from the line of contact of the creping blade with Yankee 26. This geometry is conducive to maintaining a narrow creping shelf effective width S' as shown.

Figure 11:
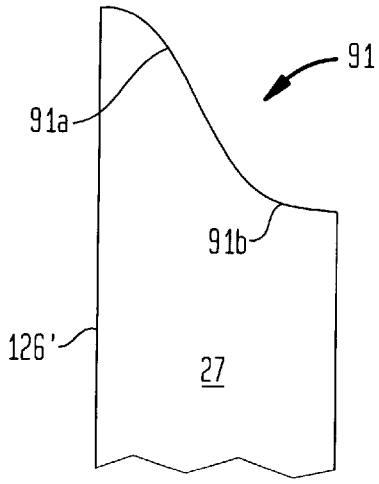
FIG. 11 illustrates schematically a creping blade with a convex profile useful for practicing the process of the present invention.

FIG. 11 shows, in profile, yet another geometry of a creping blade 27 which may be used in connection with the present invention. Blade 27 of FIG. 11 has a relief side indicated at 126' which is configured to be applied to Yankee 26 during creping and a convex upper surface 91 as shown to engage web W. Surface 91 is continuously curvilinear, having an upper convex portion 91*a* on the Yankee side 126' of the blade as well as a sloping convex portion 91*b* on the side of the blade designed to be disposed distal to the Yankee surface. A convex blade such as that shown in FIG. 11 offers a simplified, one pass, manufacturing procedure which also improves quality control. In a two step operation, such as required to make a stepped blade as shown hereinafter in connection with FIGS. 13A–13C, there is much more potential to have burrs on the various corners of the blade. A continuously variable face angle, such as that shown in FIG. 11 can perform like a narrower flat blade and have a much longer blade life. If combined with an adjustable angle doctor holder, the blade of FIG. 11 is "turned" into the Yankee as it wears, keeping the creping angle and the relative width of the shelf relatively constant.

Figure 12:
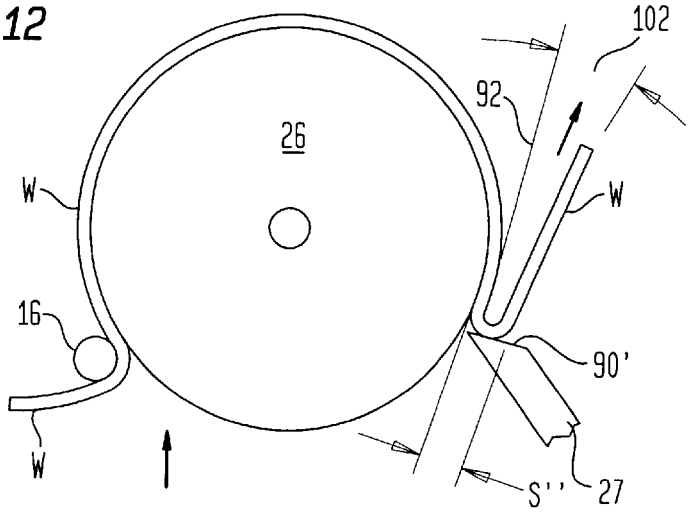
FIG. 12 is a schematic diagram illustrating accelerated sheet removal useful in connection with the present invention.

So also, accelerated sheet removal can be used to maintain a narrow creping shelf effective width as shown in FIG. 12. In FIG. 12, web W is applied to Yankee dryer 26 by way of press roll 16 as shown in FIG. 1. Thereafter, web W is creped off of the Yankee by blade 27. The sheet direction is controlled to make an angle 102 between the sheet and the tangent 92 to Yankee 26 at the line of creping of less than about 60 degrees. Angle 102 is suitably less than about 45 degrees. In this way, the creping shelf effective width, S", is kept small.

Figure 13A:
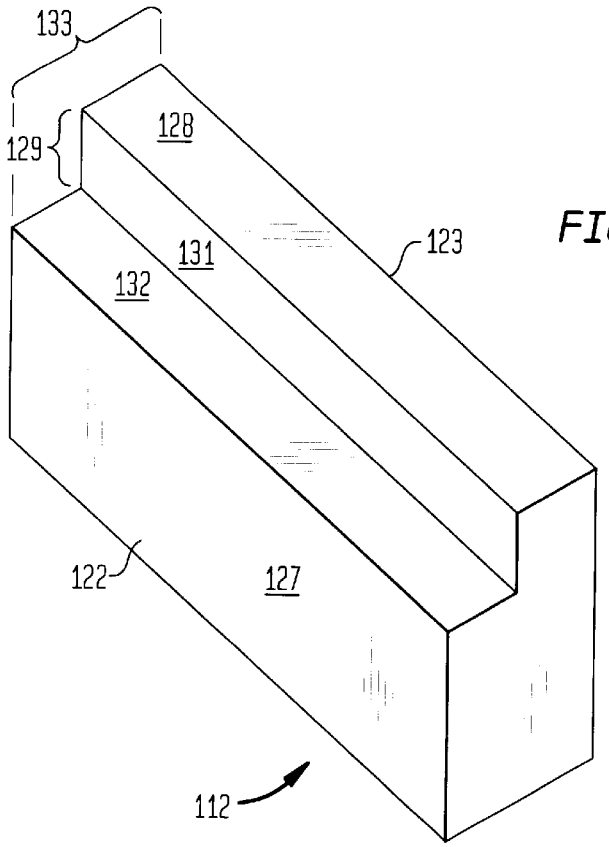
FIGS. 13A through 13C illustrate the profile of a stepped creping blade useful for practicing the process of the present invention.
Figure 13B:
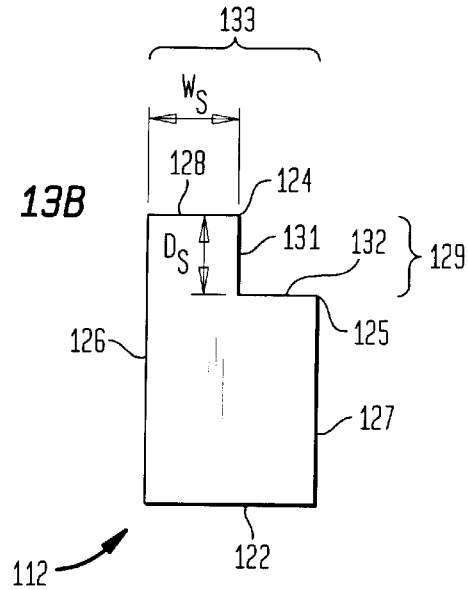
Figure 13C:
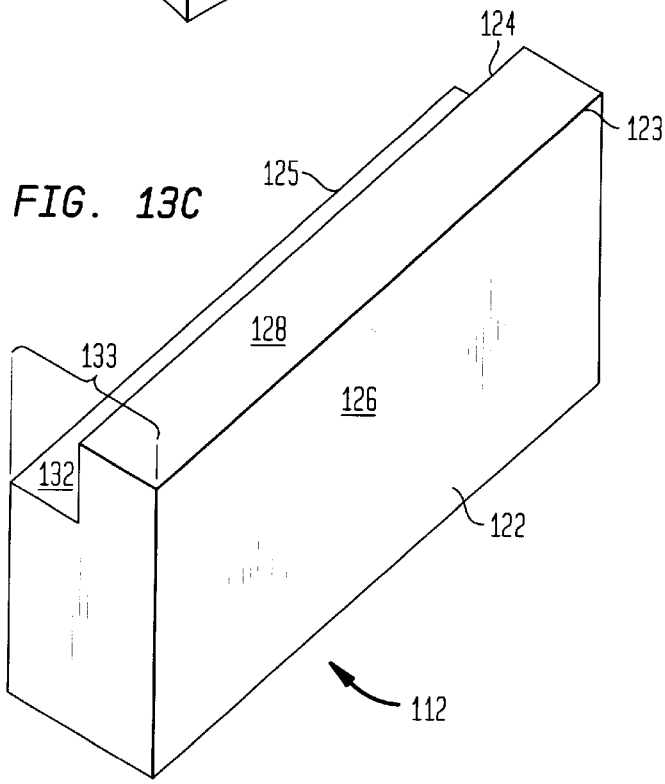

Other blade geometries may likewise be used to maintain a narrow creping shelf effective width. There is shown in FIGS. 13A–13C a portion of a creping blade with a stepped blade profile which may be utilized in accordance with the present invention. The machined stepped creping blade 112 has an upper surface 133 which includes a top surface 128 and a recessed surface 129. The recessed surface 129 of the machined embodiment includes a side surface 131 and a bottom surface 132. Machining results in a well defined step, but the machining of steel used for creping blades is a time consuming task. Alternatively, a grinder could be used to develop the ground stepped creping blade.

A front surface 126 generally faces toward a moving surface, such as a Yankee dryer. A back surface 127 is substantially parallel to the front surface 126 and generally faces away from the moving surface. The front surface 126 and the top surface 128 form a contact edge 123 which is engaged against the moving surface to crepe a cellulosic web from the moving surface. The top surface 128 and the recessed surface 129 form a back step edge 124. The recessed surface 129 and the back surface 127 form a trailing edge 125. Body 122 extends indefinitely in length, typically exceeding 100 inches in length and often reaching over 26 feet in length to correspond to the width of a Yankee dryer on more modern papermaking machines. In contrast, the thickness of the body 122 is on the order of fractions of an inch, e.g., 0.005 to 0.050 inches.

The machining or grinding of a top surface of the square blade forms a step having a depth, $D_s$ and a top surface having a width, $W_s$. In accordance with the present invention, the width, $W_s$, of the step's top surface is from 20% to 60% of the total width of the blade and the depth, $D_s$, of the step is from 100% to 300% of the top surface. Preferably, the width, $W_s$ of the step is approximately 0.005 to 0.025 inches, and the depth, $D_s$, of the step suitably proportional; however, the particular dimension will be dependent on the final paper product desired. Preferably, the step extends the entire length of the body 122 of the creping blades as shown in FIGS. 13A and 13C. See, U.S. Pat. No. 6,066,234 to Parker et al., the disclosure of which is incorporated herein by reference.

In some embodiments of the present invention, creping of the paper from a Yankee dryer is carried out using an undulatory creping blade, such as that disclosed in U.S. Pat. No. 5,690,788, noted above. Use of the undulatory crepe blade has been shown to impart several advantages when used in production of tissue products generally and especially when made primarily or entirely from recycled fibers. In general, tissue products creped using an undulatory blade have higher caliper (thickness), increased CD stretch, and a higher Void Volume than do comparable tissue products produced using conventional crepe blades. All of these changes effected by use of the undulatory blade tend to correlate with improved softness perception of the tissue products.

Another effect of using the undulatory blade is that there is a greater drop in sheet tensile strength during the creping operation than occurs when a standard creping blade is used. This drop in strength, which also improves product softness, is particularly beneficial when tissue base sheets having relatively high basis weights (>9 lbs/ream) or containing substantial amounts of recycled fiber are produced. Such products often have higher-than-desired strength levels, which negatively affect softness. In sheets including high levels of a recycled fiber, a reduction in strength equivalent to that caused by use of undulatory crepe blade can be effected, if at all, by application of extremely high levels of chemical debonders. These high debonder levels, in addition to increasing product cost, can also result in problems such as loss of adhesion between the sheet and the Yankee dryer, which adversely impacts sheet softness, runnability, felt filling, and formation of deposits in stock lines and chests. FIGS. 14A through 14C illustrate a portion of a preferred undulatory creping blade 160 of the patented undulatory blade usable in the practice of the present invention in which the body 162 extends indefinitely in length, typically exceeding 100 inches in length and often reaching over 26 feet in length to correspond-to the width of the Yankee dryer on the larger modem paper machines. Flexible blades of the patented undulatory blade having indefinite length can suitably be placed on a spool and used on machines employing a continuous creping system. In such cases the blade length would be several times the width of the Yankee dryer. In contrast, the height of the body 162 of the blade 160 is usually on the order of several inches while the thickness of the body 162 is usually on the order of fractions of an inch.

As illustrated in FIGS. 14A and 14B, an undulatory cutting edge 163 of the patented undulatory blade is defined by serrulations 166 disposed along, and formed in, one edge of the body 162 so as to define an undulatory engagement surface.

Several angles must be defined in order to describe the geometry of the cutting edge of the undulatory blade of the patented undulatory blade used in the manufacturing process of this invention. To that end, the following terms are used:

Creping angle "$\alpha$"—the angle between the rake surface of the blade 160 and the plane tangent to the Yankee at the point of intersection between the undulatory cutting edge 163 and the Yankee;

Axial rake angle "$\beta$"—the angle between the axis of the Yankee and the undulatory cutting edge 163 which is, of course, the curve defined by the intersection of the surface of the Yankee with indented rake surface of the blade 160;

Relief angle "$\gamma$"—the angle between the relief surface of the blade 160 and the plane tangent to the Yankee at the intersection between the Yankee and the undulatory cutting edge 163, the relief angle measured along the flat portions of the present blade is equal to what is commonly called "blade angle" or "holder angle".

Quite obviously, the value of each of these angles will vary depending upon the precise location along the cutting edge at which it is to be determined. The remarkable results achieved with the undulatory blades of the patented undulatory blade in the manufacture of the absorbent paper products are due to those variations in these angles along the cutting edge. Accordingly, in many cases it will be convenient to denote the location at which each of these angles is determined by a subscript attached to the basic symbol for that angle. As noted in the '788 patent, the subscripts "f", "c" and "m" refer to angles measured at the rectilinear elongate regions, at the crescent shaped regions, and the minima of the cutting edge, respectively. Accordingly, "$\gamma_f$", the relief angle measured along the flat portions of the present blade, is equal to what is commonly called "blade angle" or "holder angle".

Figure 15:
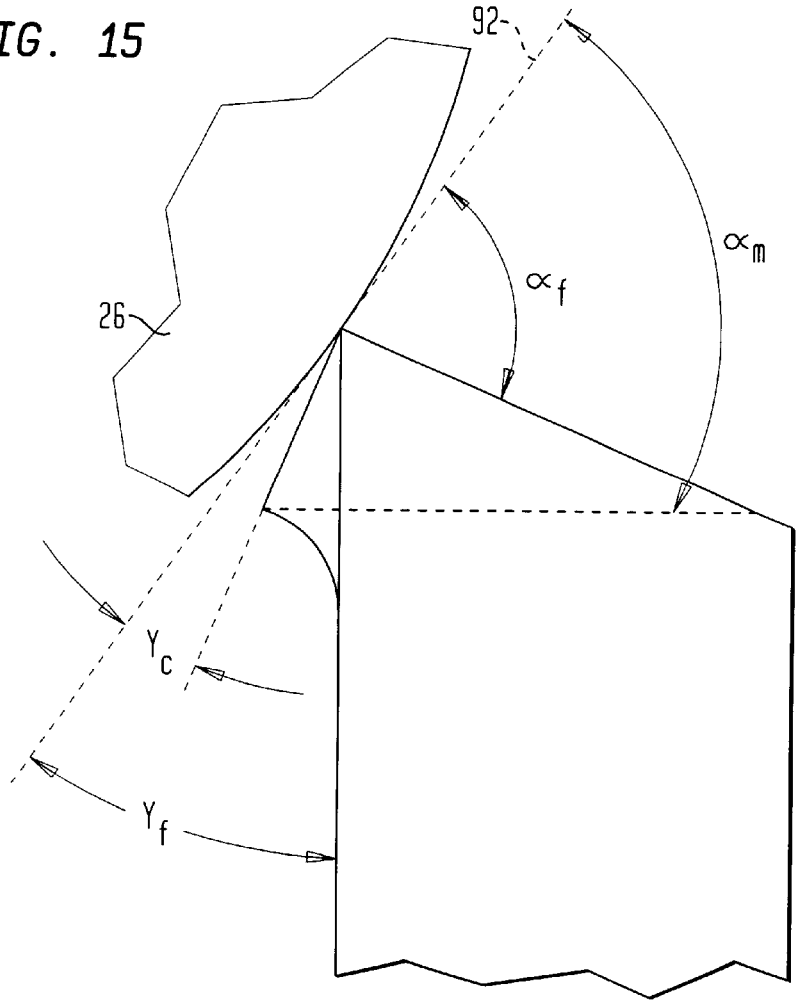
FIG. 15 illustrates creping angles used in connection with the creping blade of FIG. 8.

For example, as illustrated in FIG. 15 and the local creping angle "$\alpha$" of the patented undulatory blade is defined at each location along the undulatory cutting edge 163 as being the angle between the rake surface of the blade 160 and the plane 92 tangent to the Yankee 26. Accordingly, it can be appreciated that as shown in FIG. 15, "$\alpha_f$", the local creping angle adjacent to a substantially co-linear rectilinear elongate region of the blade is usually higher than "$\alpha_c$", the local creping angle adjacent to the nearly planar crescent-shaped bands of the blade or $\alpha_m$.

While the invention has been illustrated above in connection with a Yankee dryer, other arrangements wherein a wet web is creped from a rotating cylinder advantageously employ the wet-creping method of the present invention. Such apparatii may include impulse dryers, extended nip shoe presses and the like of the general class described in U.S. Pat. Nos. 5,997,695 and 6,017,422, the disclosures of which are hereby incorporated by reference into this application.

Figure 16:
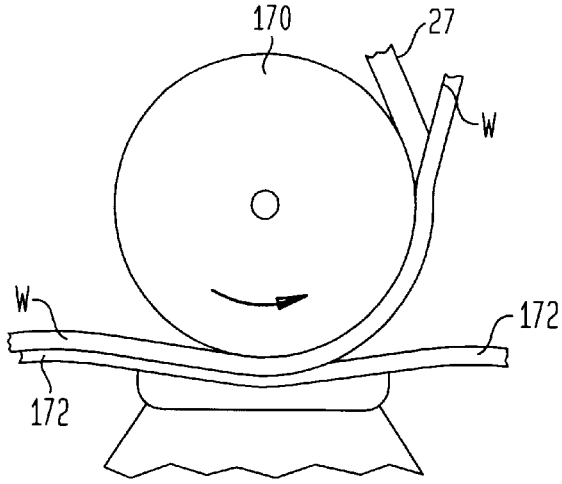
FIG. 16 is a schematic diagram showing an alternate apparatus useful for practicing the process of the present invention.

There is shown in FIG. 16 a schematic diagram of an extended nip shoe press wherein a web W is dewatered to a consistency of about 40% or so in contact with a felt 172 and whereby the web is adhered to a press roll 170. After dewatering, web W is wet creped from roll 170 by way of blade 27 and thereafter may be processed in any manner described above.

While the invention has been described in connection with numerous embodiments, modifications to those embodiments within the spirit and scope of the present invention will be readily apparent to those of skill in the art. The invention is defined in the appended claims.

What is claimed is:

1. A method of making absorbent sheet comprising:

(a) depositing an aqueous cellulosic furnish on a foraminous support;

(b) at least partially dewatering said furnish to form a nascent web;

(c) applying said nascent web to a rotating cylinder and drying said web to a consistency of from about 30 to about 90 percent;

(d) creping said web at said consistency of from about 30 to about 90 percent while maintaining a shelf effective width of less than about 3 times the thickness of the web on said rotating cylinder; and (e) thereafter drying the absorbent sheet, wherein said dried sheet exhibits a Void Volume of at least about 3.5 gms/g.

2. The method according to claim 1, wherein said step of creping said web is carried out while maintaining a creping shelf effective width of less than about twice the thickness of said web on said rotating cylinder.

3. The method according to claim 2, wherein said step of creping said web is carried out while maintaining a creping shelf effective width of less than about 1.5 times the thickness of said web on said rotating cylinder.

4. The method according to claim 3, wherein said step of creping said web is carried out while maintaining a creping shelf effective width of less than about 1.25 times the thickness of said web on said rotating cylinder.

5. A method of making absorbent sheet comprising:

(a) depositing an aqueous cellulosic furnish on a foraminous support;

(b) at least partially dewatering said furnish to form a nascent web;

(c) applying said nascent web to a heated rotating cylinder and drying said web to a consistency of from about 30 to about 90 percent solids;

(d) creping said web at said consistency of from about 30 to about 90 percent while maintaining a creping shelf effective width; and (e) drying said creped web to form said absorbent sheet, wherein said absorbent sheet exhibits a Void Volume of at least about 3.5 gms/gm;

wherein said creping shelf effective width is maintained at less than about 3 times the thickness of said absorbent sheet.

6. The method according to claim 5 wherein said absorbent sheet exhibits a Void Volume of at least about 4 gms/gm.

7. The method according to claim 6, wherein said absorbent sheet exhibits a Void Volume of at least about 5 gms/gm.

8. The method according to claim 7, wherein said absorbent sheet exhibits a Void Volume of at least about 6 gms/gm.

9. The method according to claim 8, wherein said absorbent sheet exhibits a Void Volume of at least about 7 gms/gm.

10. The method according to claim 5, wherein said creping blade has a stepped profile.

11. The method according to claim 5, wherein said creping shelf effective width is maintained at less than about 2 times the thickness of said absorbent sheet.

12. The method according to claim 11, wherein said creping shelf effective width is maintained at a width of less than about 1.5 times the thickness of said sheet.

13. The method according to claim 5, wherein said sheet has a thickness of from about 0.003 to about 0.010 inches.

14. The method according to claim 13, wherein the creping surface of said blade has a ledge width of from about 0.005 to about 0.025 inches.

15. The method according to claim 5, wherein said creping surface of said creping blade is formed from a low friction material selected from the group consisting of polished metal surfaces, ceramic surfaces, polymeric surfaces and combinations thereof.

16. The method according to claim 5, wherein said surface is a hydrophobic surface.

17. The method according to claim 16, wherein said hydrophobic surface is a polymeric surface.

18. The method according to claim 17, wherein said polymeric surface comprises a fluoropolymer.

19. The method according to claim 18, wherein said fluoropolymer is polytetrafluoroethylene.

20. The method according to claim 5, wherein said creping surface of said creping blade is a curvilinear surface.

21. The method according to claim 20, wherein said curvilinear surface of said creping blade has a decreasing radius in a direction away from the point of engagement of said creping blade with said rotating heated cylinder.

22. The method according to claim 5, wherein said creped web is removed from said creping shelf along a direction making an angle of less than about 60° with a tangent to said heated rotating cylinder at the line of engagement of said creping blade with said heated rotating cylinder.

23. The method according to claim 22, wherein said creped web is removed from said creping shelf along a direction making an angle of less about 45° with a tangent to said heated rotating cylinder at the line of engagement of said creping blade with said heated rotating cylinder.

24. The method according to claim 5, wherein said aqueous cellulosic furnish comprises recycled fiber.

25. The method according to claim 24, wherein said aqueous cellulosic furnish consists essentially of recycled fiber.

26. The method according to claim 5, wherein said aqueous cellulosic furnish comprises from about 5 to about 90 percent recycled fiber based on the weight of fiber present in said furnish.

27. The method according to claim 5, wherein said absorbent sheet has from about 10 to about 150 creped bars per inch.

28. The method according to claim 5, wherein said creping blade has a serrulated creping surface.

29. A method of making absorbent sheet comprising:

(a) depositing an aqueous cellulosic furnish on a foraminous support;

(b) at least partially dewatering said furnish to form a nascent web;

(c) applying said nascent web to a heated rotating cylinder and drying said web to a consistency of from about 30 to about 90 percent solids;

(d) creping said web at said consistency of from about 30 to about 90 percent while maintaining a narrow creping shelf, wherein the creping surface of the creping blade has a creping ledge of from about 0.005 to about 0.025 inches in width; and (e) drying said creped web to form said absorbent sheet wherein said absorbent sheet exhibits a Void Volume of at least about 3.5 gms/gm and wherein the creping shelf effective width is maintained at a width of less than about 3 times the thickness of said absorbent sheet.

30. The method according to claim 29, wherein said furnish is at least partially dewatered utilizing a papermaking felt.

31. The method according to claim 29, wherein said creped web is throughdried on an impression fabric.

32. The method according to claim 29, wherein said creped web is macroscopically rearranged on said impression fabric.

33. The method according to claim 29, wherein said creping blade has a serrulated creping surface.

34. The method according to claim 33, wherein said absorbent sheet has from about 4 to about 50 ridges in the machine direction.

35. The method according to claim 34, wherein said absorbent sheet has from about 10 to about 150 crepe bars per inch.

36. The method according to claim 29, wherein said creping blade has a bevel of from about 0 to about 50°.

37. The method according to claim 36, wherein said creping blade has a bevel of from about 5 to about 15°.

38. The method according to claim 29, wherein said creped web is transferred over an open draw with the aid of an air foil.

39. The method according to claim 38, wherein said air foil is a Coanda effect air foil.

40. A method of making absorbent sheet comprising:

(a) depositing an aqueous cellulosic furnish on a foraminous support;

(b) at least partially dewatering said furnish to form a nascent web;

(c) applying the nascent web to a rotating cylinder and drying the web to a consistency of from about 30 to about 90 percent solids;

(d) creping the web at said consistency of from about 30 to about 90 percent while maintaining a narrow creping shelf, wherein the creping surface of the creping blade has a creping ledge width of from about 0.005 to about 0.025 inches; and (e) drying the creped web to form the absorbent sheet wherein the absorbent sheet exhibits a Void Volume of at least about 3.5;

wherein said creping shelf effective width is maintained at less than about 3 times the thickness of said absorbent sheet.

41. The method according to claim 40, wherein said furnish is dried utilizing a shoe press.

42. The method according to claim 40, wherein said creped web is macroscopically rearranged on an impression fabric.

43. The method according to claim 42, wherein said web is dried using a can dryer.

44. The method according to claim 40, wherein said absorbent sheet has a thickness of from about 0.003 inches to about 0.010 inches.

* * * * *

UNITED STATES PATENT AND TRADEMARK OFFICE

CERTIFICATE OF CORRECTION

PATENT NO. : 6,558,510 B1 
DATED : May 6, 2003
INVENTOR(S) : Steven L. Edwards et al.

It is certified that error appears in the above-identified patent and that said Letters Patent is hereby corrected as shown below:

Column 2,
Line 14, change “Multiply” to -- Multi-ply --
Line 21, delete “)”;
Line 34, insert -- ( -- after “[”;

Column 5,
Line 53, delete “)”;
Line 58, change “porofil” to -- POROFIL --;

Column 6,
Line 63, insert -- any -- after “contain”;

Column 7,
Line 16, insert -- by -- after “procured”;
Line 37, change “modem” to -- modern --;

Column 8,
Line 4, change “Eipichlorohydrin” to -- Epichlorohydrin --;
Line 24, change “dialkyldimethylammuonium” to -- dialkyldimethylammonium --;

Column 10,
Line 67, change “quaterary” to -- quaternary --;

Column 11,
Line 32, change “form” to -- from --;
Line 32, change “moities” to -- moieties --;
Line 34, change “C12 to C20” to -- C to C --;
Line 35, change “moities” to -- moieties --;

Column 12,
Line 36, change “Example” to -- Examples --;
Line 44, change “polyacrylamnide” to -- polyacrylamide --;
Line 57, change “dislcosed” to -- disclosed --;
Line 63, change “54,490,903” to -- 5,490,903 --;

Column 14,
Line 9, change “section so” to -- sections --;

Column 15,
Line 10, change “as” to -- is --;
Line 28, change “slot” to -- slots --;

UNITED STATES PATENT AND TRADEMARK OFFICE

CERTIFICATE OF CORRECTION

PATENT NO. : 6,558,510 B1 
DATED : May 6, 2003
INVENTOR(S) : Steven L. Edwards et al.

It is certified that error appears in the above-identified patent and that said Letters Patent is hereby corrected as shown below:

Column 16,
Line 13, change "bout" to -- about --;
Line 26, delete "s" after "length";
Line 46, delete "width effective" and insert -- effective width --;

Column 18,
Line 31, delete "-"; and

Column 19,
Line 12, delete "and".

Signed and Sealed this

Thirtieth Day of September, 2003

JAMES E. ROGAN
*Director of the United States Patent and Trademark Office*